US011525644B1

(12) United States Patent
Flick

(10) Patent No.: US 11,525,644 B1
(45) Date of Patent: Dec. 13, 2022

(54) MULTI-MATERIAL FIREARM RECEIVER

(71) Applicant: Warren Jacob Flick, Nashville, TN (US)

(72) Inventor: Warren Jacob Flick, Nashville, TN (US)

( * ) Notice: Subject to any disclaimer, the term of this patent is extended or adjusted under 35 U.S.C. 154(b) by 0 days.

(21) Appl. No.: 17/839,044

(22) Filed: Jun. 13, 2022

Related U.S. Application Data

(60) Provisional application No. 63/255,781, filed on Oct. 14, 2021.

(51) Int. Cl.
*F41A 3/66* (2006.01)
*F41C 23/06* (2006.01)

(52) U.S. Cl.
CPC ..... *F41A 3/66* (2013.01); *F41C 23/06* (2013.01)

(58) Field of Classification Search
CPC ..... F41A 3/66
See application file for complete search history.

(56) References Cited

U.S. PATENT DOCUMENTS

2020/0271403 A1* 8/2020 Ives ..... F41A 3/66
2020/0378718 A1* 12/2020 Sun ..... F41C 23/10
2021/0270551 A1* 9/2021 Underwood ..... F41A 35/06
2022/0136788 A1* 5/2022 Caudle ..... F41A 11/02 42/18
2022/0252367 A1* 8/2022 Robinson ..... F41A 3/66

* cited by examiner

*Primary Examiner* — J. Woodrow Eldred
(74) *Attorney, Agent, or Firm* — Morris, Manning & Martin, LLP; Adam J. Thompson, Esq.

(57) ABSTRACT

A metallic component of a lower receiver for a firearm is disclosed herein. The metallic component includes a body with apertures between a first side of the body and a second side of the body. The body can be configured to mate with another component of the lower receiver along the second side. The two lower receiver components can be detachably affixed together via the apertures. The body can have a ring-shaped protrusion at a first end. The ring-shaped protrusion can extend outward perpendicular to the first side and the second side.

20 Claims, 24 Drawing Sheets

MULTI-MATERIAL FIREARM RECEIVER

CROSS REFERENCE TO RELATED APPLICATIONS

This application claims the benefit of, and priority to, U.S. Provisional Application No. 63/255,781, filed Oct. 14, 2021, entitled "MULTI-MATERIAL FIREARM RECEIVER," the disclosure of which is incorporated herein by reference in its entirety.

TECHNICAL FIELD

The present apparatuses, systems, and methods relate generally to firearm design and, more particular, to a multi-material firearm.

BACKGROUND

The AR-15 rifle (originally a product of ArmaLite) is one of the most ubiquitous firearms of the $20^{th}$ and $21^{st}$ centuries. The AR-15 is a robust semi-automatic firearm that is extremely popular amongst civilians across the United States and other countries. The AR-15's popularity stems from its modularity and durability. Typically, an AR-15 is created using aluminum alloys or other lightweight metals to reduce weight. These metal components can include, but are not limited to, the upper receiver, the lower receiver, charging handle, barrel, and bolt carrier groups.

With the rise of 3D printing and other polymer materials, it has been increasingly common to replace traditional firearm components with polymer counterparts. For example, individuals have attempted to make entire AR-15 firearms out of polymer components. When creating an AR-15 out of polymer, and more specifically the receiver (upper and lower receiver), the strength is drastically reduced. Pertaining to the lower receiver, the takedown/pivot pins and buffer tube/receiver extension attachment area are extremely susceptible to fracture when constructed of polymer. These areas susceptible to fracture are the focal points of stress resulting from recoil forces, striking the firearm on surfaces, dropping the firearm, using the firearm as a weight-bearing implement, and other scenarios encountered during the recreational and tactical use of a firearm.

Therefore, there is a long-felt but unresolved need for a system or method that incorporates polymer components in a firearm without reducing the structural integrity of the rifle.

BRIEF SUMMARY OF THE DISCLOSURE

Briefly described, and according to one embodiment, aspects of the present disclosure generally relate to apparatuses, systems, and methods for multi-material firearm construction. In particular embodiments, the disclosed system includes a receiver of a firearm constructed using polymer and metal components.

An AR-15 rifle (originally a product of ArmaLite) and any of its derivatives can include a receiver set, a barrel, and a buttstock. In at least one embodiment, the receiver set connects to the buttstock and the barrel to form the main components of the firearm. The receiver set can include, but is not limited to, an upper receiver, a lower receiver, a charging handle, a bolt carrier group, a trigger, a grip, and a magazine to create an operational firearm. In one or more embodiments, a user fills the magazine with ammunition for firing. In various embodiments, the magazine is loaded into the receiver, and the charging handle is pulled to the rear and released to chamber an ammunition cartridge into the firearm. In certain embodiments, the user pulls the trigger, which releases the hammer, strikes the firing pin, ignites the ammunition, and discharges a projectile. The projectile can launch from the receiver and can exit the firearm through the barrel. In some embodiments, the recoil and cycling of the action created from discharging the ammunition cartridge creates a force that is exerted on the user through the buttstock. In at least one embodiment, other locations where forces are exerted after discharging the ammunition cartridge include, but are not limited to, the bolt carrier group, the receiver, and the grip. In one or more embodiments, the expanding gasses propelling the projectile down the barrel are tapped off through a gas port in the barrel and redirected to the action of the firearm via the gas block and gas tube. The expanding gasses can flow through the gas key (a component of the bolt carrier) and into the space in between the bolt and the bolt carrier, forcing the bolt carrier rearward, which simultaneously rotates the bolt into the unlocked position via a cam. In some embodiments, during this rearward travel, the bolt will extract and eject the spent ammunition cartridge case from the firearm. In various embodiments, upon the bolt carrier group (bolt and bolt carrier) reaching the end of its rearward travel, it is pushed forward by the recoil spring until the bolt is locked into the chamber, in the process removing an ammunition cartridge from the magazine and inserting it into the chamber. On completion of these steps, the firearm may now be fired again.

A receiver made entirely of polymer can be damaged by the forces produced by discharging the firearm and by impacts or loads undergone during the course of tactical and recreational scenarios. The recoil, the resulting forces from holding a rifle, drops, strikes, and loads, can cause stress to be focused on certain areas of the receiver. Those forces can exceed the strength of the polymer alone, thereby fracturing the material. Some areas of the receiver that can experience substantial stress during use are, but are not limited to, a takedown pin insert location, a pivot pin insert location, and the buffer tube/receiver extension attachment area. In particular embodiments, to maintain the structural integrity of the receiver while incorporating polymer components, the upper receiver and a portion of the lower receiver can be made out of metal. For example, the upper receiver and a first portion (e.g., a top portion) of the lower receiver can be made out of aircraft-grade aluminum, while the second portion (e.g., bottom portion) of the lower receiver can be made out of polymer or other plastic material. The top portion of the lower receiver can be machined, stamped, pressed, cast, cut, extruded, forged, or made through another metal forming process. The bottom portion can be extruded, injection-molded, 3D printed, or another plastic forming process. The injection molding can include reaction injection molding, plastic injection molding, or other injection molding processes. The top and bottom portions of the lower receiver can append together to form a substantially durable connection. Appending techniques can include, but are not limited to, gluing, screwing, epoxying, riveting, heat staking, molding, ultrasonic appending, and cold pressing.

By creating the upper receiver and the top portion of the lower receiver out of metal and the remaining portion out of polymer, the firearm can maintain structural integrity while reducing weight, cost, and increasing manufacturability. While the terms "top," "bottom," "front," "rear," "upper," and "lower" are used herein, it can be appreciated that these terms are used for clarity and are not intended to convey an orientation of a firearm.

According to a first aspect, a metallic component of a lower receiver for a firearm, comprising: A) a body comprising a plurality of apertures between a first side and a second side opposite the first side, wherein the body is configured to mate with a second component of the lower receiver along the second side and to be detachably affixed to the second component of the lower receiver via the plurality of apertures; and B) a ring-shaped protrusion at a first end of the body, the ring-shaped protrusion extending outward from the first side away from the second side and perpendicular to the first side and the second side.

According to a further aspect, the metallic component of the first aspect or any other aspect, wherein the metallic component comprises a first material with a first compressive strength exceeding a second compressive strength of a second material of the second component of the lower receiver.

According to a further aspect, the metallic component of the first aspect or any other aspect, wherein the metallic component comprises a first material with a first shear strength exceeding a second shear strength of a second material of the second component of the lower receiver.

According to a further aspect, the metallic component of the first aspect or any other aspect, wherein the ring-shaped protrusion is configured to mate between a buttstock and an upper receiver of the firearm.

According to a further aspect, the metallic component of the first aspect or any other aspect, wherein individual ones of the plurality of apertures comprise respective threads and the body is configured to mate with the second component of the lower receiver by individual inserting a plurality of screws through a plurality of second apertures in the second component of the lower receiver and secured into the respective threads.

According to a further aspect, the metallic component of the first aspect or any other aspect, wherein the body is configured to mate with the second component of the lower receiver by individual inserting a plurality of screws through a respective one the plurality of apertures and into the second component of the lower receiver.

According to a further aspect, the metallic component of the first aspect or any other aspect, wherein the body is configured to mate with the second component of the lower receiver by individual inserting a plurality of pins through a respective one the plurality of apertures and into the second component of the lower receiver.

According to a second aspect, a method, comprising: A) positioning a second side of a body of a metallic component of a lower receiver against a second component of the lower receiver; B) inserting a plurality of fasteners to secure the metallic component with the second component, wherein the plurality of fasteners at least partially pass into a plurality of apertures between a first side of the metallic component and the second side of the metallic component, wherein the first side is opposite the second side; and C) affixing a buttstock onto a ring-shaped protrusion at a first end of the body of the metallic component.

According to a further aspect, the method of the second aspect or any other aspect, wherein inserting the plurality of fasteners comprises individually inserting a plurality pins through the second component and into a respective one of the plurality of apertures in the metallic component.

According to a further aspect, the method of the second aspect or any other aspect, wherein inserting the plurality of fasteners comprises: A) inserting a plurality of screws through the second component; and B) individually screwing each of the plurality of screws into a respective one of the plurality of apertures in the metallic component.

According to a further aspect, the method of the second aspect or any other aspect, further comprising printing, via a three-dimensional printer, at least a portion of the second component of the lower receiver.

According to a further aspect, the method of the second aspect or any other aspect, wherein the metallic component comprises a lesser volume than the second component, and the metallic component comprises a greater weight than the second component.

According to a further aspect, the method of the second aspect or any other aspect, further comprising affixing an upper receiver against the ring-shaped protrusion opposite the buttstock.

According to a further aspect, the method of the second aspect or any other aspect, wherein the buttstock comprises a buffer tube and a spring.

According to a further aspect, the method of the second aspect or any other aspect, further comprising shipping the metallic component to a user for assembly by the user.

According to a further aspect, the method of the second aspect or any other aspect, further comprising injecting a plastic material into a mold to form the second component.

According to a third aspect, a system, comprising: A) a metallic component of a lower receiver of a firearm comprising: 1) a body comprising a plurality of apertures between a first side and a second side opposite the first side; and 2) a ring-shaped protrusion at a first end of the body, the ring-shaped protrusion extending outward from the first side away from the second side and perpendicular to the first side and the second side; and B) a plurality of fasteners configured to individually be at least partially inserted into a respective one of the plurality of apertures, wherein the body of the metallic component is configured to be affixed with a second component of the lower receiver via the plurality of fasteners.

According to a further aspect, the system of the third aspect or any other aspect, wherein the metallic component is configured to dissipate a kickback force received by the lower receiver in response to a projectile being launched from the firearm.

According to a further aspect, the system of the third aspect or any other aspect, wherein the metallic component is configured to couple with an upper receiver along the first side of the body.

According to a further aspect, the system of the third aspect or any other aspect, further comprising an end plate positioned against the ring shaped protrusion and configured to: A) be secured to the ring shaped protrusion by a castle nut and a buffer tube; and B) secure the plurality of fasteners in the plurality of apertures to affix the body of the metallic component to the second component of the lower receiver when the end plate is secured to the ring shaped protrusion.

These and other aspects, features, and benefits of the claimed invention(s) will become apparent from the following detailed written description of the preferred embodiments and aspects taken in conjunction with the following drawings, although variations and modifications thereto may be effected without departing from the spirit and scope of the novel concepts of the disclosure.

BRIEF DESCRIPTION OF THE DRAWINGS

The accompanying drawings illustrate one or more embodiments and/or aspects of the disclosure and, together with the written description, serve to explain the principles of the disclosure. Wherever possible, the same reference numbers are used throughout the drawings to refer to the same or like elements of an embodiment, and wherein.

DETAILED DESCRIPTION

Figure 1:
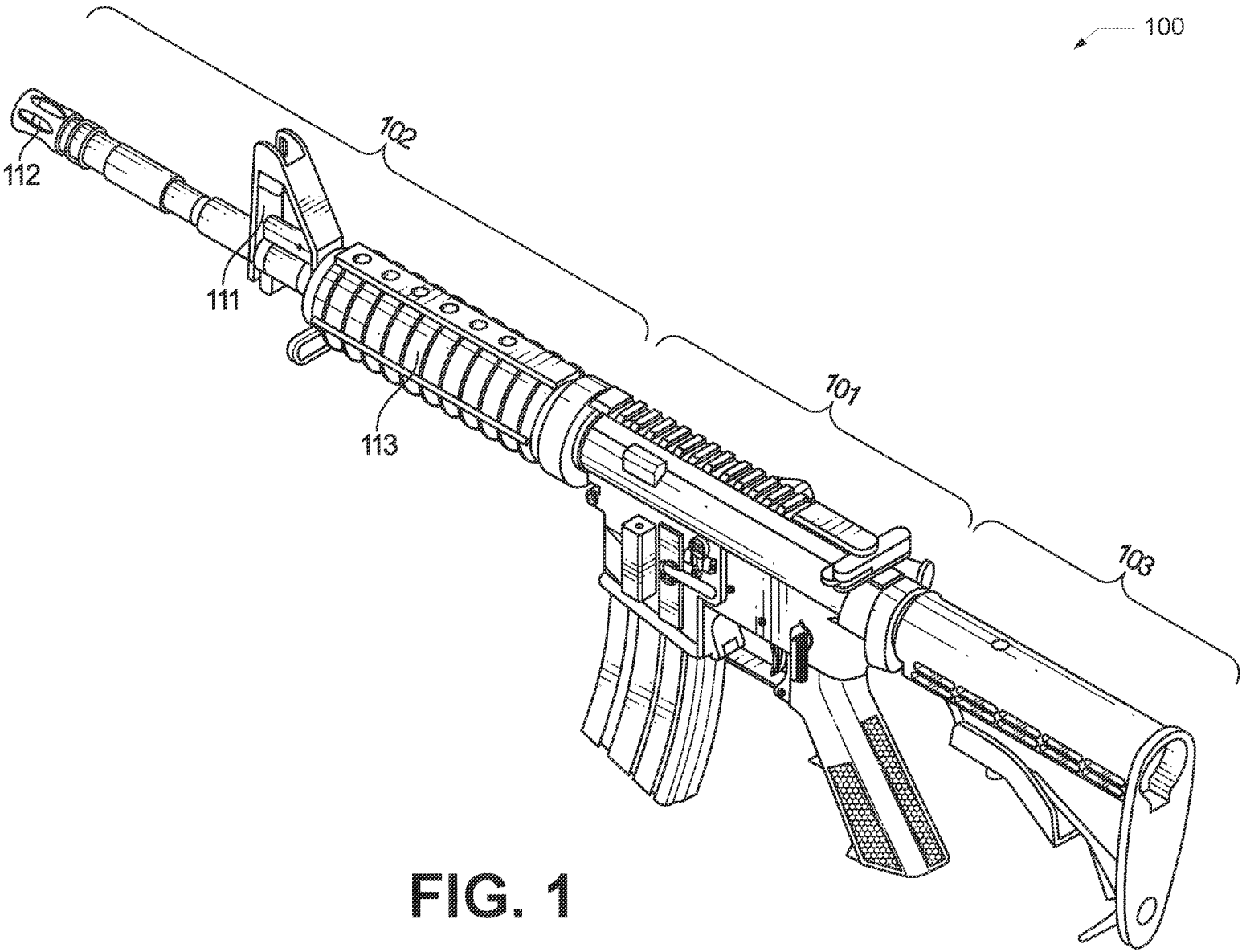
FIG. 1 illustrates a perspective view of a multi-material firearm, according to one embodiment of the present disclosure.

For the purpose of promoting an understanding of the principles of the present disclosure, reference will now be made to the embodiments illustrated in the drawings and specific language will be used to describe the same. It will, nevertheless, be understood that no limitation of the scope of the disclosure is thereby intended; any alterations and further modifications of the described or illustrated embodiments, and any further applications of the principles of the disclosure as illustrated therein are contemplated as would normally occur to one skilled in the art to which the disclosure relates. All limitations of scope should be determined in accordance with and as expressed in the claims.

Whether a term is capitalized is not considered definitive or limiting of the meaning of a term. As used in this document, a capitalized term shall have the same meaning as an uncapitalized term, unless the context of the usage specifically indicates that a more restrictive meaning for the capitalized term is intended. However, the capitalization or lack thereof within the remainder of this document is not intended to be necessarily limiting unless the context clearly indicates that such limitation is intended.

Overview

Aspects of the present disclosure generally relate to a multi-material firearm. The multi-material firearm can include a receiver, a barrel, and a buttstock. In at least one embodiment, the receiver connects to the buttstock and the barrel to form the main components of the firearm. The receiver can include, but is not limited to, an upper receiver portion, a lower receiver portion, a charging handle, a bolt carrier group, a trigger, a grip, and a magazine to create an operational firearm. In one or more embodiments, a user fills the magazine with ammunition for firing. In various embodiments, the magazine is loaded into the receiver and the charging handle is pulled to the rear and released to chamber an ammunition cartridge into the firearm. In certain embodiments, the user pulls the trigger, which releases the hammer, strikes the firing pin, ignites the ammunition, and discharges a projectile. The projectile can launch from the receiver and can exit the firearm through the barrel. In some embodiments, the recoil and cycling of the action created from discharging the ammunition cartridge creates a force that is exerted on the user through the buttstock. In at least one embodiment, other locations where forces are exerted after discharging the ammunition cartridge include, but are not limited to, the bolt carrier group, the receiver, and the grip. In particular embodiments, the expanding gasses propelling the projectile down the barrel are tapped off through a gas port in the barrel and redirected to the action of the firearm via the gas block and gas tube. In some embodiments, the gas will flow through the gas key (a component of the bolt carrier) and into the space in between the bolt and the bolt carrier, forcing the bolt carrier rearward, which simultaneously rotates the bolt into the unlocked position via a cam. During this rearward travel, the bolt can extract and eject the spent ammunition cartridge case from the firearm. In at least one embodiment, upon the bolt carrier group (bolt and bolt carrier) reaching the end of its rearward travel, the bolt carrier group is pushed forward by the recoil spring until the bolt is locked into the chamber, in the process removing an ammunition cartridge from the magazine and inserting it into the chamber. On completion of these steps, the firearm may now be fired again.

A receiver made entirely of polymer can be damaged by the forces produced from discharging the firearm and by impacts or loads undergone during the course of tactical and recreational scenarios. The recoil, the resulting forces from holding a rifle, drops, strikes, and loads, can cause stress to be focused on certain areas of the receiver. Those forces can exceed the strength of the polymer, thereby fracturing the material. Some areas of the receiver that can experience substantial stress during use are, but are not limited to, a takedown pin insert location, a pivot pin insert location, and the buffer tube/receiver extension attachment area. In particular embodiments, to maintain the structural integrity of the receiver while incorporating polymer components, the upper receiver and a portion of the lower receiver are made out of metal. For example, the upper receiver and the top portion of the lower receiver are made out of aircraft-grade aluminum, while the remaining portion of the receiver is made out of polymer. The top and bottom portions of the lower receiver can append together to form a substantially durable connection. Appending techniques can include, but are not limited to, gluing, screwing, epoxying, riveting, heat staking, molding, ultrasonic appending, and cold pressing.

By creating the upper receiver and the top portion of the lower receiver out of metal and the remaining portion out of polymer, the firearm can maintain structural integrity while reducing weight, cost, and increasing manufacturability.

Exemplary Embodiments

Referring now to the figures, for the purposes of example and explanation of the fundamental processes and components of the disclosed apparatuses, systems, and methods, reference is made to FIG. 1, which illustrates an exemplary, high-level overview of one embodiment of a multi-material firearm 100. As will be understood and appreciated, the exemplary, multi-material firearm 100 shown in FIG. 1 represents merely one approach or embodiment of the present disclosure, and other aspects are used according to various embodiments of the present disclosure.

The multi-material firearm 100 can include a receiver set 101, a barrel 102, and a buttstock 103. The buttstock 103 can include a receiver extension/buffer tube 1403, endplate/anti rotation lock 1401, castle nut 1402 (see FIG. 14), buffer, buffer spring, and any other component necessary for a functional buttstock 103. In various embodiments, the barrel 102 and the buttstock 103 attach to the receiver set 101 by screwing to a second thread 312 and a first thread 311 (See FIG. 3A), respectively. The barrel 102 can include a gas system (not pictured), a sight 111, a muzzle 112, and a handguard 113. In some embodiments, the barrel 102 is made out of a combination of different materials (e.g., stainless steel, aluminum, titanium, polymer). For example, the barrel 102 is made out of stainless steel to combat rusting and corrosion. Although presently depicted as a typical AR-15 variant firearm, the multi-material receiver can be applied to any particular type of firearm. For example, a multi-material receiver can apply to handguns, shotguns, bolt-action rifles, other semi-automatic rifle variations, fully automatic firearms, and/or any other particular firearm.

Figure 2:
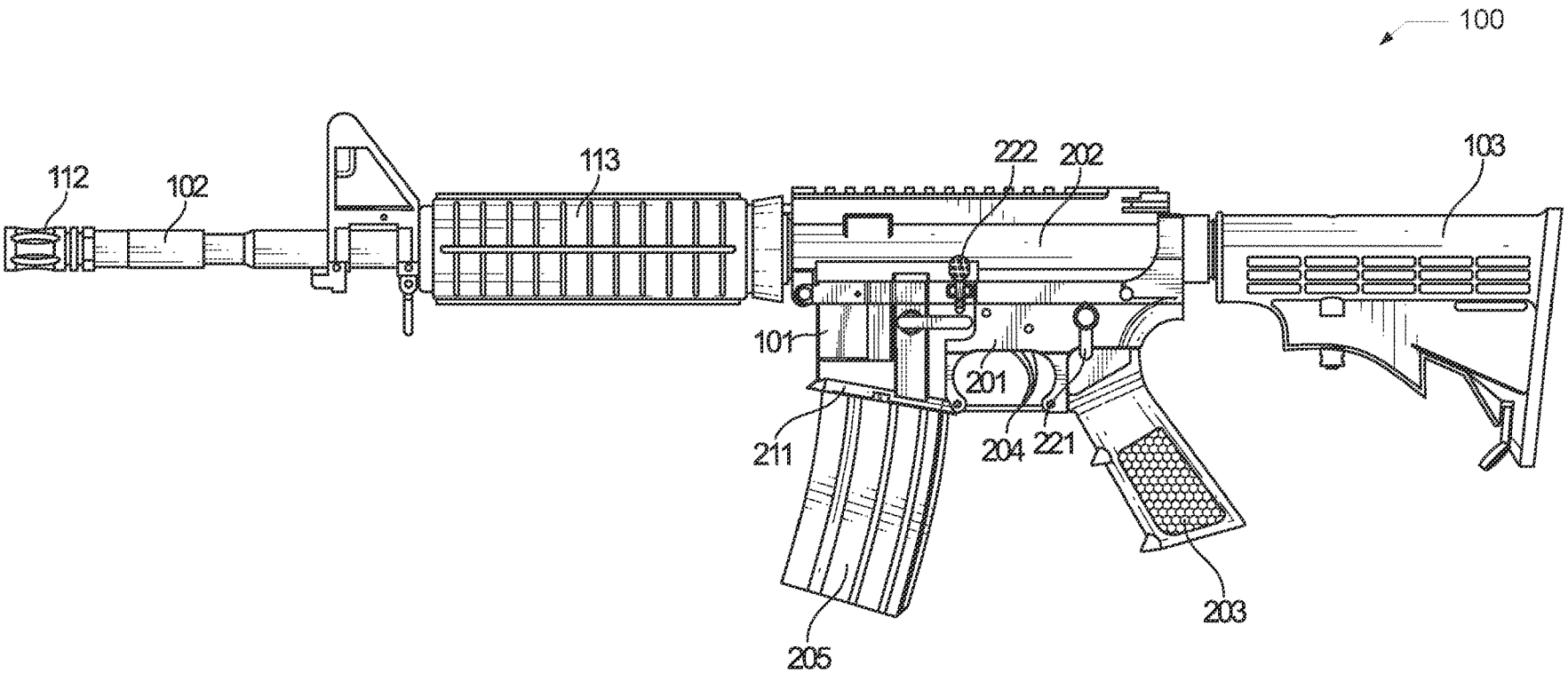
FIG. 2 illustrates a side view of a multi-material firearm, according to one embodiment of the present disclosure.

Referring now to FIG. 2, illustrated is a side view of a multi-material firearm 100, according to one embodiment of the present disclosure. The receiver set 101 can include, but is not limited to, a first lower receiver 201, an upper receiver 202, a grip 203, a trigger group 204, a magazine well 211, a safety selector 221, and a bolt catch 222. During operation, a user can insert a loaded magazine 205 into the magazine well 211. A loaded magazine 205 can include any type of cartridge that dispenses a bullet for firing (referred to herein as a "round"). The user can hold the rifle at the grip 203 and can place their finger on the trigger 204. The user can place their second hand on the handguard 113 for increased stabilization. The user can rest the buttstock 103 on their shoulder for increased stabilization. To shoot the multi-material firearm 100, the user can change the fire select from safety to semi-automatic. Semi-automatic can be defined as a state where a firearm shoots one round per trigger pull and reloads a round after every subsequent shot. A user can chamber a round by pulling the charging handle (not pictured) to the rear and subsequently releasing the charging handle. When a round has been chambered, a user can fire the round by pulling the trigger 204. Pulling a trigger can release the hammer, striking the firing pin, which impacts the round and ignites the gun powder. When the gun powder ignites, the round can produce a substantial amount of pressure that ejects the bullet through the barrel 102 and the muzzle 112.

Figure 3A:
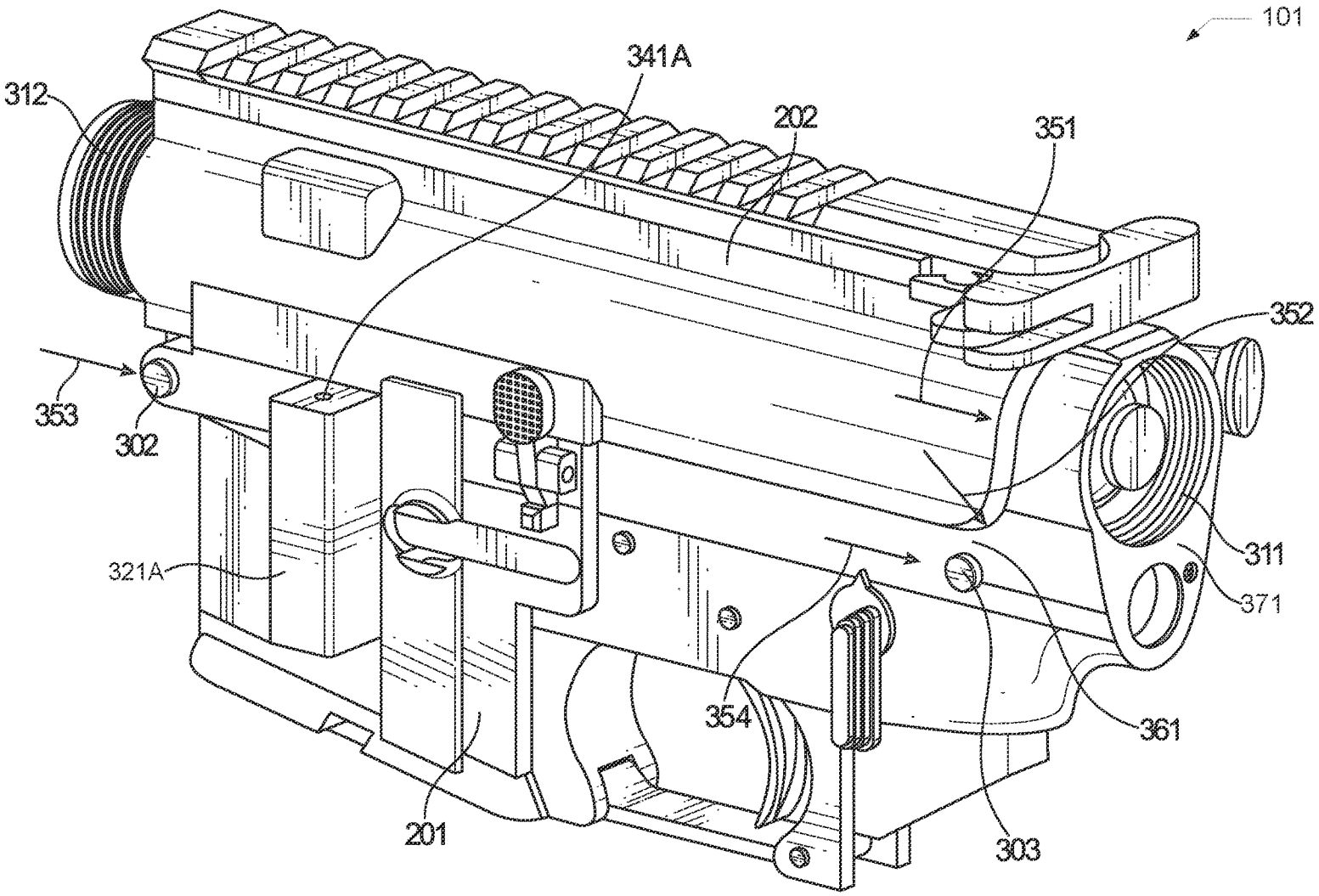
FIG. 3A illustrates a perspective view of a first lower receiver and an upper receiver, according to one embodiment of the present disclosure.

The force produced by the explosion of the gunpowder can exert a force on the firearm and the user (see FIG. 3A). For example, the force can exert on the user through the buttstock 103. The receiver set 101 can experience forces produced from discharging an ammunition cartridge. In another example, when a receiver set 101 is fully created using polymer components, the continual firing can cause the receiver set 101 to break in particular areas. Other forces encountered during the recreational or tactical use of a firearm can also cause it to break, such as strikes, drops, or loads. The gas produced from discharging an ammunition cartridge can also return the bolt carrier group to an unfired state.

In one or more embodiments, the upper receiver 202 is manufactured using metal components. The first lower receiver 201 can be manufactured using a combination of polymer and metal components. Metal components used for the upper receiver 202 and portions of the first lower receiver 201 can include, but are not limited to, aircraft-grade aluminum, titanium, and stainless steel. The polymer material used for portions of the first lower receiver 201 can include, but is not limited to, nylon, polyethylene terephthalate, and polyethylene.

Figure 6:
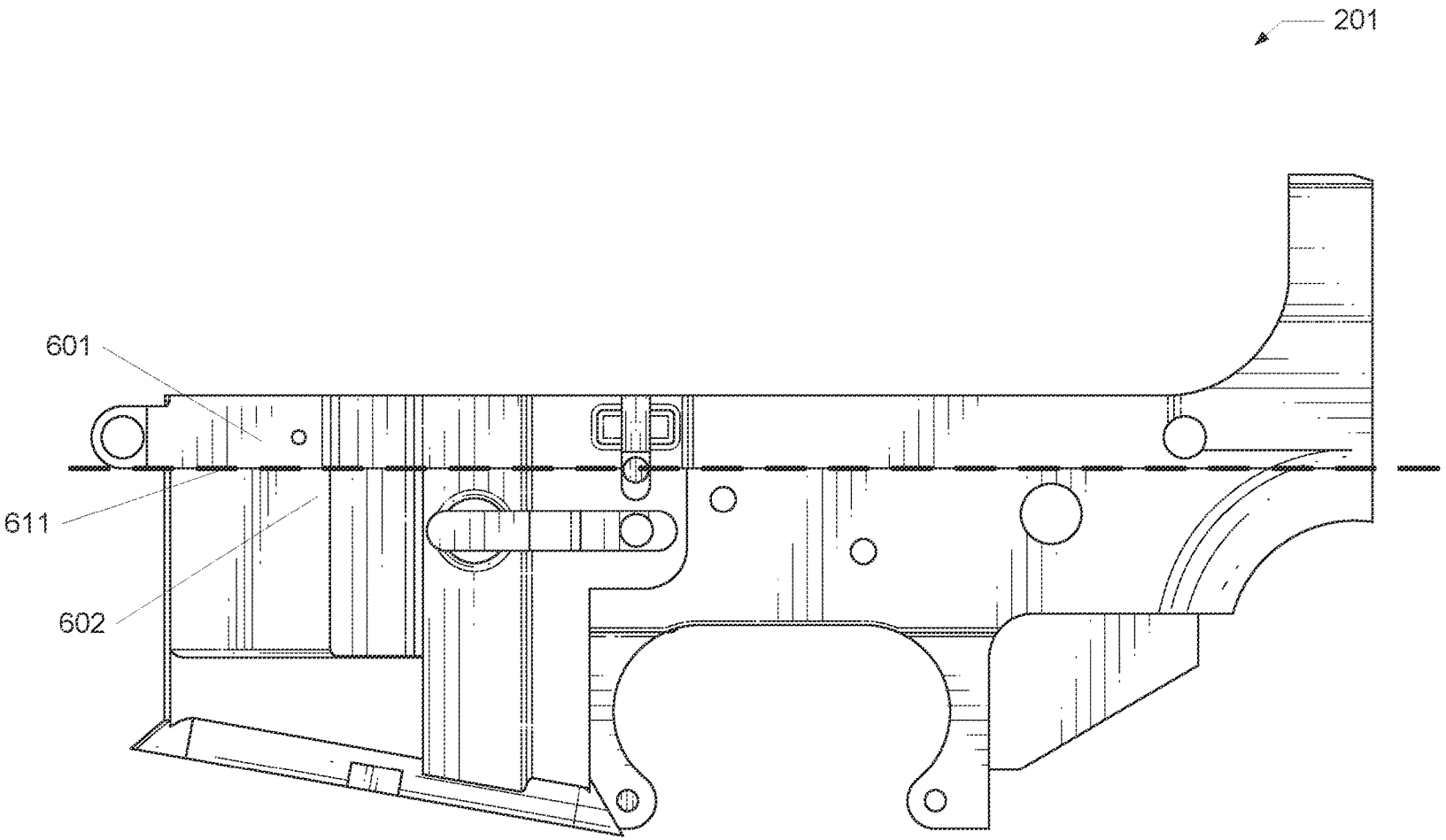
FIG. 6 illustrates a first side view of the first lower receiver, according to one embodiment of the present disclosure.

Referring now to FIG. 3A, illustrated is a perspective view of the receiver set 101, according to one embodiment of the present disclosure. The receiver set 101 can include a takedown pin 303, a pivot pin 302, a first thread 311, a second thread 312, and an appending body 321A. The takedown pin 303 and the pivot pin 302 connect and fix the upper receiver 202 to the first lower receiver 201. The first thread 311 of the first lower receiver 201 can connect the buttstock 103 to the first lower receiver 201. In various embodiments, the second thread 312 of the upper receiver 202 can connect the upper receiver 202 to the barrel 102. The appending body 321A can connect a lower receiver metal component 601 (FIG. 6) to a lower receiver polymer component 602 (FIG. 6). The appending body 321A can include an aperture 341A (e.g., a threaded aperture), which receives a screw to connect and compress the lower receiver metal component 601 to the lower receiver polymer component 602 together. Each side of the multi-material firearm 100 can have the appending body 321A to increase the connection between the particular components. A third aperture 1003 (FIG. 10) used to connect the lower receiver metal component 601 to the lower receiver polymer component 602 can be found at the rear of the receiver near the grip aperture 1004.

During discharging of a round and the scenarios in which the rifle may be in use, the upper receiver 202 and the first lower receiver 201 can experience one or more forces. As an example, the upper receiver 202 and the first lower receiver 201 can experience one or more of: a force 351, a force 352, a force 353, and a force 354. In various embodiments, more forces act on the multi-material firearm 100, but for the purpose of simplifying the explanation, the forces 351, 352, 353, and 354 are highlighted herein. The forces 351-354 can be produced from the explosion of a round when firing a multi-material firearm 100 and/or from drops, strikes, or loads. Firing the multi-material firearm 100 and/or drops, strikes, or loads can exert the force 351 on the buttstock 103. Firing the multi-material firearm 100 and/or drops, strikes, or loads can exert the force 352 on a bend 361. If the first lower receiver 201 was made from a polymer material, the lower receiver can deteriorate at the bend 361, among potentially other areas, due to the various forces 351-354. The lower receiver may break at the bend 361 if made completely out of polymer. A broken lower receiver can make the firearm unusable. Firing the multi-material firearm 100 and/or drops, strikes, loads, can exert the force 353 and 354 on the pivot pin 302 and the takedown pin 303, respectively. The surrounding lower receiver, when made out of polymer, can increase the likelihood of damage after each subsequent round shot and/or drops, strikes, and loads. The multi-material firearm 100 can address this fault by creating the lower receiver metal component 601 (See FIG. 6) out of a metal material. Using the lower receiver metal component 601, the multi-material firearm 100 can greatly absorb the forces 351-354 produced from discharging an ammunition cartridge and/or drops, strikes, or loads. Stated differently, by using metal at the portion of the first lower receiver 201 that is most susceptible to breaking due to forces from firing the multi-material firearm 100 and/or drops, strikes, or loads, the first lower receiver 201 can be made significantly lighter than a lower receiver made from metal without sacrificing the durability typical to a full metal lower receiver.

Figure 3B:
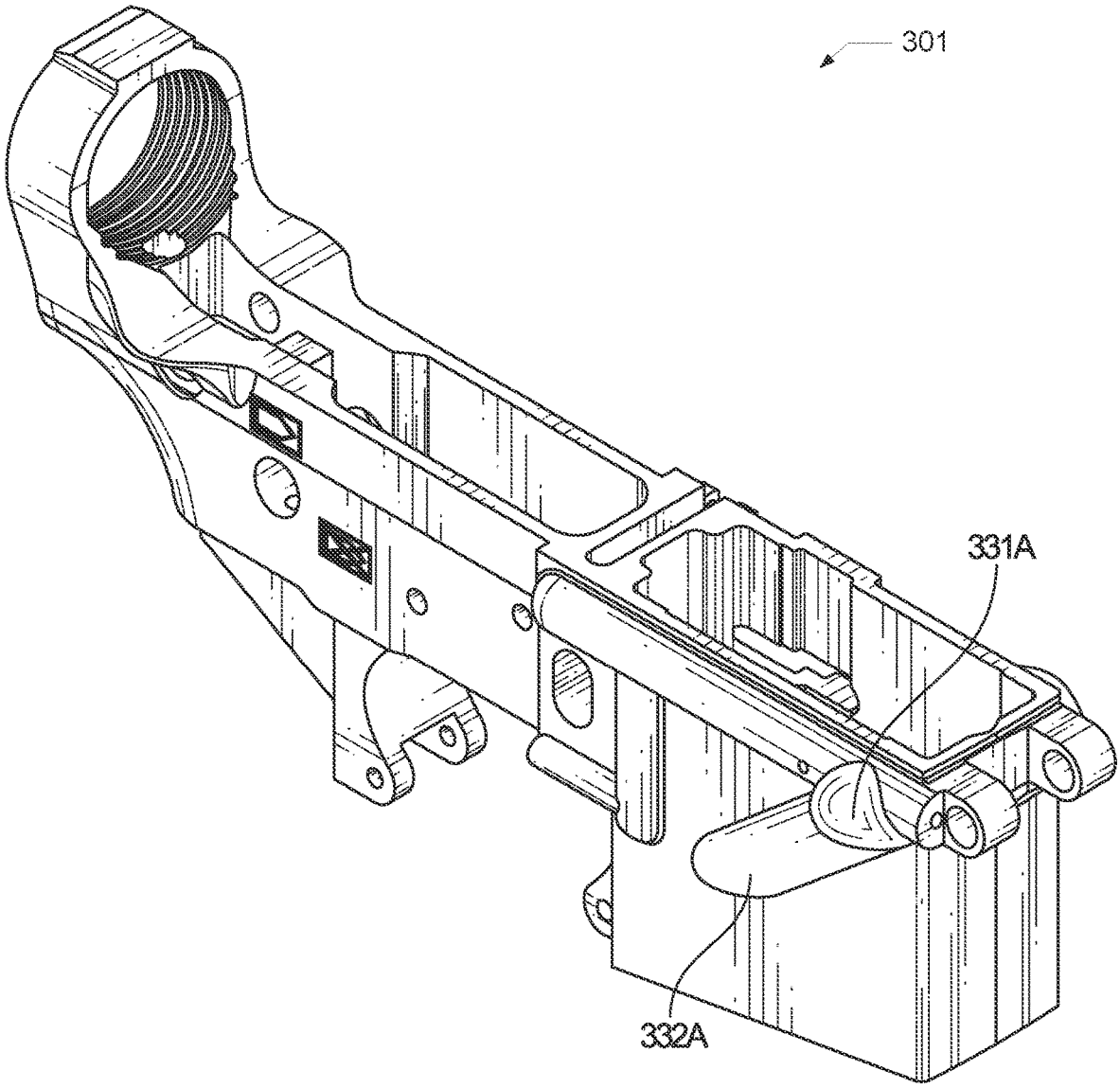
FIG. 3B illustrates a perspective view of a second lower receiver, according to one embodiment of the present disclosure.

Referring now to FIG. 3B, illustrated is a perspective view of a second lower receiver 301, according to one embodiment of the present disclosure. In one or more embodiments, the second lower receiver 301 is substantially similar to the second lower receiver 201 with a different polymer and metal appending mechanism. The second lower receiver 301 can include an appending leg 331A, an appending channel 332A, and an appending channel 332C.

A ridged material fastener can form the appending leg 331A extending through the appending channels 332A. For example, a ridged material fastener can include, but is not limited to, screws, pins, rivets, and metal protrusions. In some embodiments, the connection between the appending leg 331A and the appending channel 332A marks the transitional surface between a lower receiver metal component 401 and a lower receiver polymer component 402 (see FIG. 4). The lower receiver 301 can include one or more legs 331 that form a connection to one or more appending channels 332. In one or more embodiments, the appending leg 331A and the appending channel 332A are at an angle relative to the top surface of the lower receiver metal component 401 such that the endplate/anti rotation lock 1401, once secured by the receiver extension/buffer tube 1403 and castle nut 1402, will compress the lower receiver metal component 401 and the lower receiver polymer component 402 together, forming a substantially suitable connection. In one example, the endplate/anti rotation lock 1401 can slide over the receiver extension/buffer tube 1403 and up against the first lower receiver 201. Continuing this example, the endplate/anti rotation lock 1401 can be secured by the castle nut 1402, which can be threaded onto the receiver extension/buffer tube 1403. In some embodiments, the endplate/anti rotation lock 1401 prevents during use the receiver extension/buffer tube 1403 from rotating and unthreading from the first lower receiver 201. The endplate/anti rotation lock 1401 can compress and hold the lower receiver polymer component 402 and the lower receiver metal component 401 together. In various embodiments, the endplate/anti rotation lock 1401 constrains the lower receiver polymer component 402 from rearward motion relative to lower receiver metal component 401. In particular embodiments, the appending legs 331A-C and appending channels 332A-C are at an angle relative to the merging line 411 such that the lower receiver metal component 401 must move towards the endplate/anti rotation lock 1401 to decouple from the lower receiver polymer component 402. In certain embodiments, the endplate/anti rotation lock 1401 secures and affixes the lower receiver metal component 401 to the lower receiver polymer component 402 by constraining the rearward motion of the lower receiver polymer component 402 and/or the lower receiver metal component 401. In some embodiments, the reward motion of the lower receiver polymer component 402 is necessary for the lower receiver metal component 401 to separate from the lower receiver polymer component 402 given the geometry of the appending legs 331A-C and the appending channels 332A-C. Appending techniques can include, but are not limited to, riveting, heat staking, molding, ultrasonic appending, and cold pressing. The opposing side of the firearm (not shown in FIG. 3B) has an identical appending leg 331B and appending channel 332B to maximize the coupling force/hold between the two components.

Figure 4:
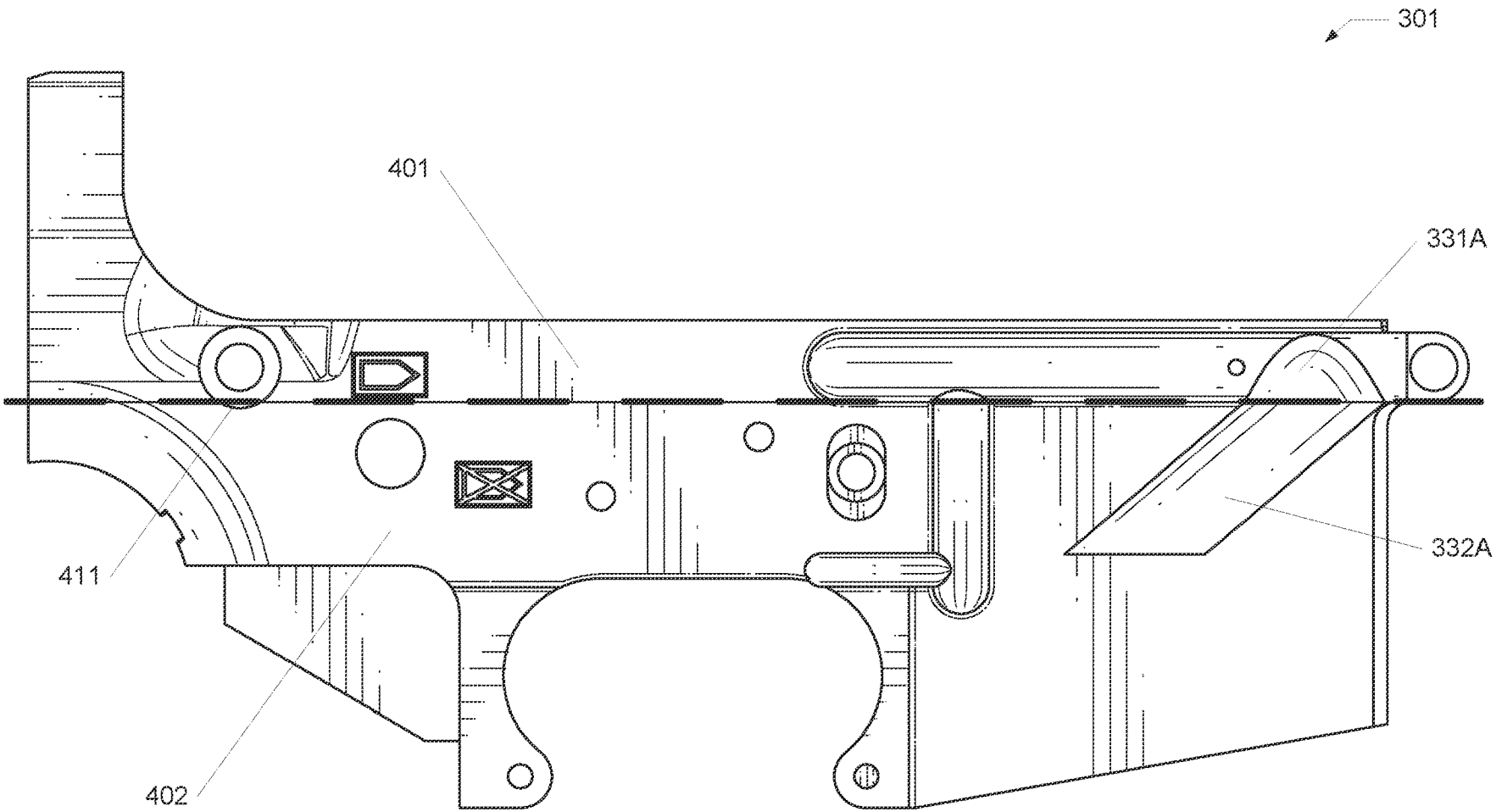
FIG. 4 illustrates a side view of the second lower receiver, according to one embodiment of the present disclosure.

Referring now to FIG. 4, illustrated is a side view of the second lower receiver 301, according to one embodiment of the present disclosure. In various embodiments, the second lower receiver 301 can include a lower receiver metal component 401, a lower receiver polymer component 402, and a merging line 411. The merging line 411 can demarcate the segment where the lower receiver metal component 401 connects with the lower receiver polymer component 402. The merge line 411 is shown for illustrative purposes and does not necessarily signify an actual dashed line on the lower receiver 301. An appending technique can be applied to the merging line 411 to fix the lower receiver metal component 401 to the lower receiver polymer component 402. For example, glue can be applied to a second side of the lower receiver metal component 401 at the merging line 411 and pressed against the lower receiver polymer component 402. Continuing this example, a pin can be applied through the appending leg 331A and through the appending channel 332A. Other appending channels and appending legs can include similar connection techniques. Combining the appending technique at the merging line 411 with the appending technique at the appending leg 331A and the appending channel 332A can provide an enhanced hold between the lower receiver metal component 401 and the lower receiver polymer component 402.

The appending leg 331A can receive a pin, or any ridged material, that extends through the appending channel 332A. For example, the appending leg 331A can have an aperture that accepts a pin. Continuing this example, the pin can be inserted into the appending channel 332A and pressure fitted into the appending leg 331A. The pin or any other ridged material can extend through the appending channel 332A to the appending leg 331A, connecting both components. In some embodiments, the pin or any other ridged material can be inserted through the appending channel 332A and rotated to lock into one or more grooves in the appending channel 332A. Glue, welding, soldering, and/or any other appending technique can be applied to the pin, appending channel 332A, and the appending leg 331A to increase the hold between the lower receiver metal component 401 and the lower receiver polymer component 402. The appending leg 331A can include a protrusion that extends through the appending channel 332A. For example, a pin is welded, manufactured, and/or attached to the appending leg 331A to create the protrusion. Continuing this example, the protrusion of the appending leg 331A is pressure fit into the appending channel 332 to secure the lower receiver metal component 401 to the lower receiver polymer component 402. In some embodiments, a locking pin is placed through the appending channel 332A and/or the appending leg 331A. The locking pin can be inserted in a specific configuration and turned to a specific configuration to lock the appending channel 332A to the appending leg 331A.

Figure 5:
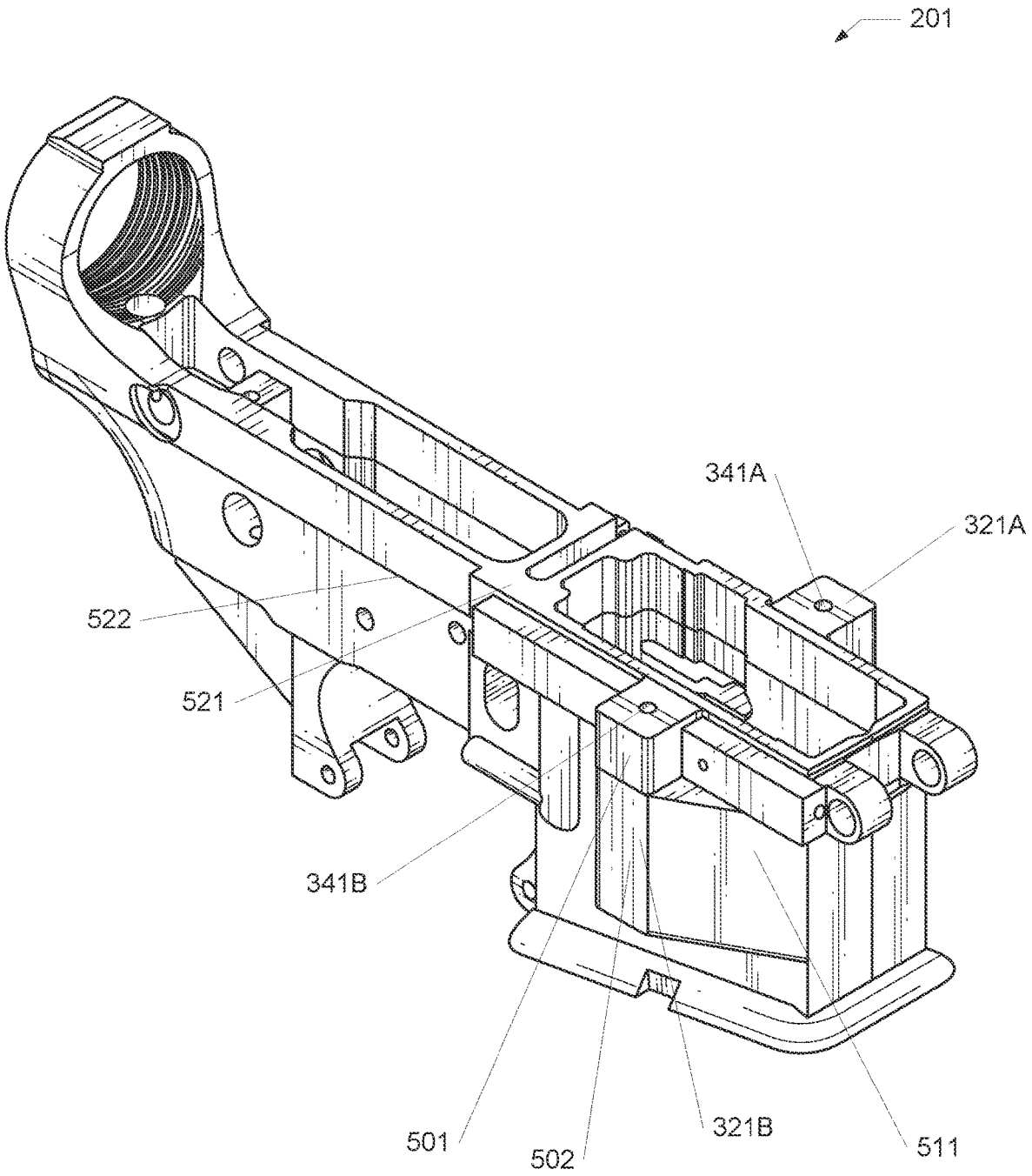
FIG. 5 illustrates a perspective view of the first lower receiver, according to one embodiment of the present disclosure.

Referring now to FIG. 5, illustrated is a perspective view of the first lower receiver 201, according to one embodiment of the present disclosure. The first lower receiver 201 can include the appending body 321A, an appending body 321B, and a curved surface 511. In particular embodiments, the appending body 321A and 321B are substantially similar but on opposite sides of the first lower receiver 201. The appending bodies 321A and 321B can be used to fix the lower receiver metal component 601 to the lower receiver polymer component 602 (see FIG. 6). The appending bodies 321A and 321B can extend perpendicularly from the surface of the first lower receiver 201.

The appending bodies 321A-B can include a metal attachment component 501 and a polymer attachment component 502. In various embodiments, the metal attachment component 501 of the appending body 321A includes the aperture 341A. In particular embodiments, the appending body 321B can also include a similar aperture 341B. The apertures 341A-B can define the location where a screw is inserted and fixed. The screw and/or any other appending mechanism can extend through the metal attachment component 501 and the polymer attachment component 502. The appending bodies 321A-B can include appending channels that receive the screw, bolt, or any ridged appending material. The appending channels of the appending bodies 321A-B can include a threaded surface to receive a fastener, for example, a screw. In one or more embodiments, fastening a screw, bolt, or any threaded fastener can tighten the connection between the lower receiver metal component 601 and the lower receiver polymer component 602.

The curved surface 511 can provide additional structural integrity to the polymer attachment component 502. For example, as force is applied to the polymer attachment component 502 during use, the curved surface 511 can reduce and distribute the force exerted on the polymer attachment component 502.

The first lower receiver 201 can include a first surface 521, which can be referred to as a top surface. In various embodiments, the first surface 521 can receive an upper receiver 202. In some embodiments, the first surface 521 is opposite to a second surface 522. The second surface 522 can be located in between the lower receiver metal component 601 and the lower receiver polymer component 602. The second surface 522 can be located on the lower receiver metal component 601.

Referring now to FIG. 6, illustrated is a first side view of the first lower receiver 201, according to one embodiment of the present disclosure. In some embodiments, the first lower receiver 201 can include the lower receiver metal component 601 and the lower receiver polymer component 602. In various embodiments, the lower receiver metal component 601 is manufactured using aircraft-grade aluminum, titanium, stainless steel, and any other form of metal suitable for firearm systems. In at least one embodiment, the lower receiver polymer component 602 can be manufactured using nylon, polyethylene terephthalate, polyethylene, and any other form of polymer suitable for firearm systems. The lower receiver metal component 601 can include a first compressive strength that is greater than a second compressive strength of the lower receiver polymer component 602. The lower receiver metal component 601 can include a first shear strength that is greater than a second shear strength of the lower receiver polymer component 602. The lower receiver metal component 601 can include a first impact strength that is greater than a second impact strength of the lower receiver polymer component 602. The lower receiver metal component 601 can have a greater volume and weight as compared to the lower receiver polymer component 602. As an example, the lower receiver metal component 601 can be made from a metal and the lower polymer component can be made from a light weight polymer, where the metal has a greater shear strength, compressive strength, and impact strength than polymer.

The lower receiver metal component 601 can be manufactured using a computer numerical control (CNC) system, forging, casting, cutting, machining, welding, and/or any particular manufacturing technique. The lower receiver polymer component 602 can be manufactured using press molding, injection molding, three-dimensional (3-D) printing, additive manufacturing techniques, and/or any particular manufacturing method. In some embodiments, the lower receiver metal component 601 and/or the lower receiver polymer components 602 can be manufactured as an incomplete lower receiver metal component and/or an incomplete lower receiver polymer component (not pictured), respectively. In various embodiments, the incomplete lower receiver metal component and/or the incomplete lower receiver polymer component can exclude certain features such that the first lower receiver 201 is in an incompleted configuration. In the incompleted configuration, the incomplete lower receiver metal component and/or the incomplete lower receiver polymer component cannot accept all necessary components to readily expel a projectile. In one example, the incomplete lower receiver metal component and/or the incomplete lower receiver polymer component can exclude the fire control group cavity, which is required for encorporating fire control components (e.g., trigger, hammer) and for expeling the projectile. The incomplete lower receiver metal component and/or the incomplete lower receiver polymer component can exclude any particular section of the first lower receiver 201 to categorize either component in the incomplete configuration. In certain embodiments, the lower receiver polymer component 602 can form a substantially large portion of the first lower receiver 201. In various embodiments, the lower receiver polymer component can form a substantially small portion of the first lower receiver 201. For example, the lower receiver polymer component 602 can make up at least 99% of the first lower receiver 201 and can house all of the fire control components. Continuing this example, the lower receiver metal component 601 can make up at least 1% of the first lower receiver 201 and cannot house all of the fire control components. In at least one embodiment, the lower receiver metal component 601 can include less than 80% of the total volume of the first lower receiver 201 where the lower receiver polymer component 602 corresponds to the greater than 20% of the total volume of the first lower receiver 201. For example, the lower receiver metal component 601 can formulate at least 1% of the total volume of the first lower receiver 201, or about 1%-5%, 5%-10%, 10%-15%, 15%-20%, or less than about 20%.

The lower receiver metal component 601 can be substantially similar to the lower receiver metal component 401. The lower receiver metal component 601 can use a distinct appending technique compared to the lower receiver metal component 401. The lower receiver metal component 601 can include a metal body and various apertures.

The lower receiver metal component 601 and the lower receiver polymer component 602 can be divided by a merging line 611. The merging line 611 can be substantially similar to the merging line 411. The merging line 611 can mark the region where the lower receiver metal component 601 meets the lower receiver polymer component 602. In various embodiments, along with a mechanical appendage between the lower receiver metal component 601 and the lower receiver polymer component 602, a supplemental appending technique can be employed to enhance the joining of the two components. For example, the lower receiver metal component 601 can be appended to the lower receiver polymer component 602 using screws, as described in the following description.

Figure 7:
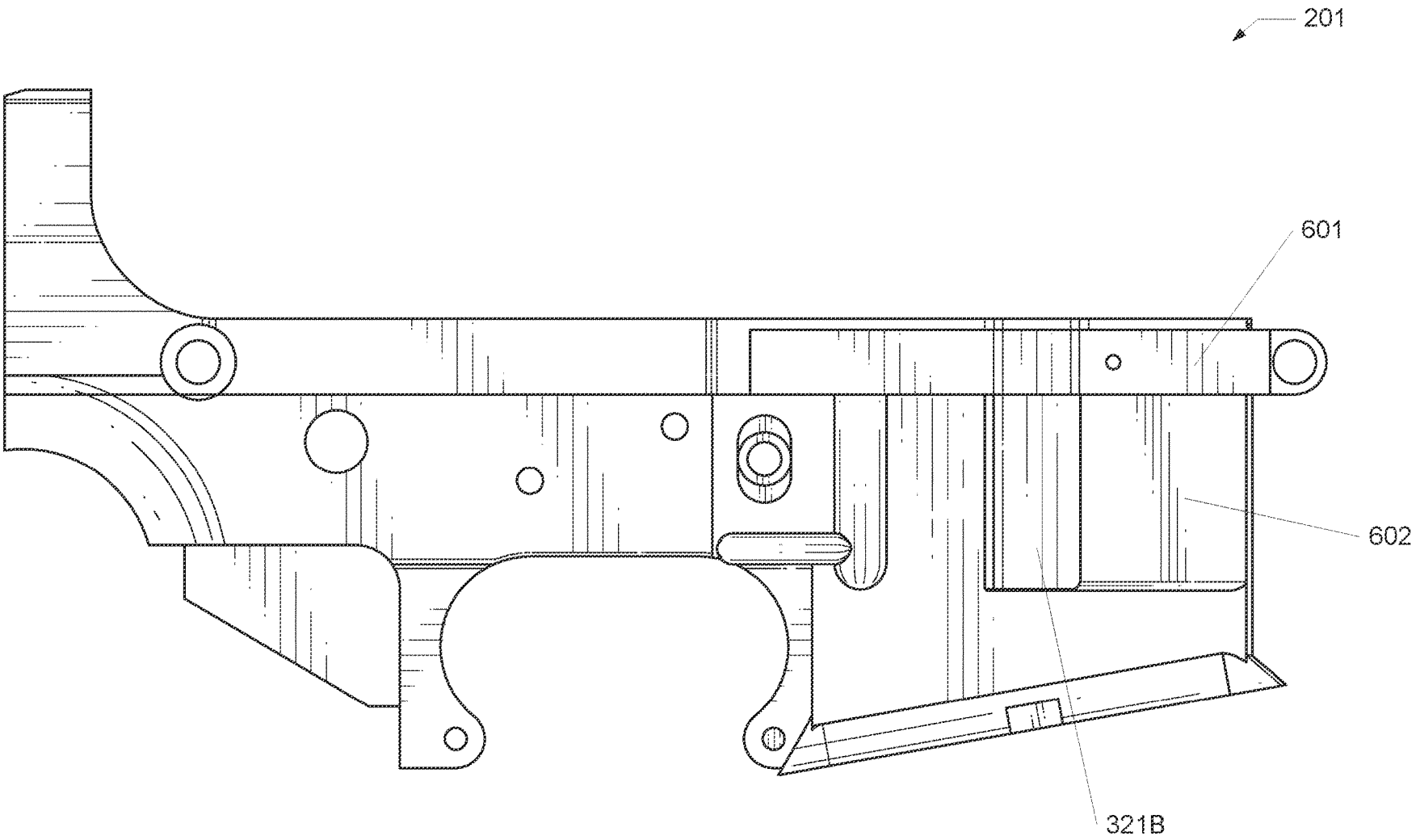
FIG. 7 illustrates a second side view of the first lower receiver, according to one embodiment of the present disclosure.

Referring now to FIG. 7, illustrated is a second side view of the first lower receiver 201, according to one embodiment of the present disclosure. In some embodiments, the first lower receiver 201 can include the appending body 321B on the second side. The appending body 321B is substantially similar to the appending body 321A. The first lower receiver 201 can include appending bodies 321A-B on both sides to increase the hold between the lower receiver metal component 601 and the lower receiver polymer component 602.

Figure 8B:
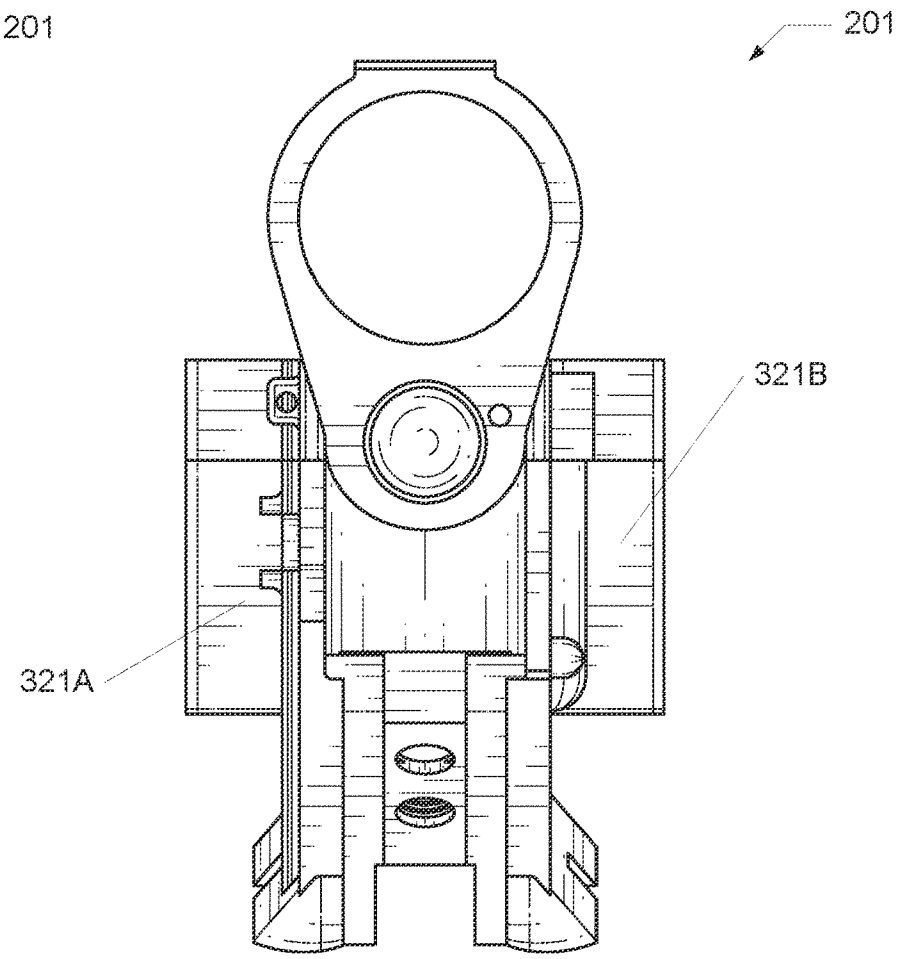
FIG. 8B illustrates a rear view of the first lower receiver, according to one embodiment of the present disclosure.
Figure 8A:
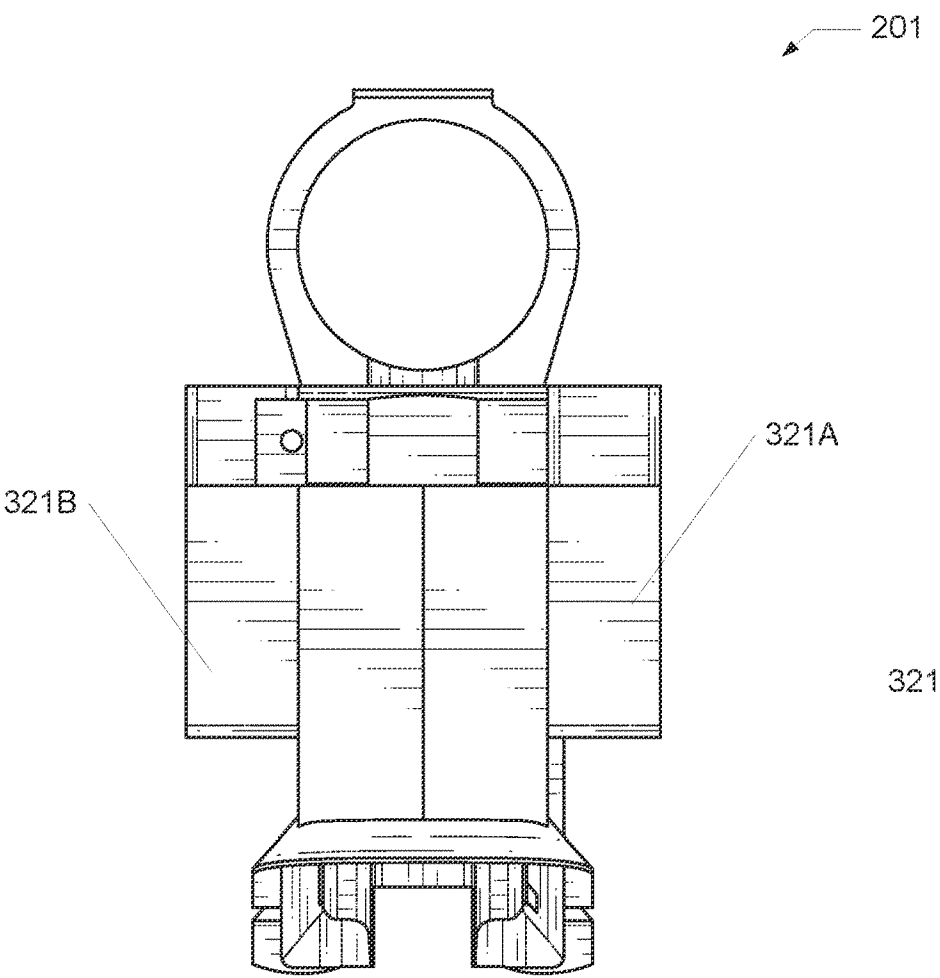
FIG. 8A illustrates a front view of the first lower receiver, according to one embodiment of the present disclosure.

Referring now to FIG. 8A, illustrated is a front view of the first lower receiver 201, according to one embodiment of the present disclosure. In particular embodiments, the appending bodies 321A-B extend perpendicularly from the surface of the first lower receiver 201.

Referring now to FIG. 8B, illustrated is a rear view of the first lower receiver 201, according to one embodiment of the present disclosure. Similar to FIG. 8A, the appending bodies 321A-B are shown to protrude perpendicularly from the surface of the first lower receiver 201.

Figure 9:
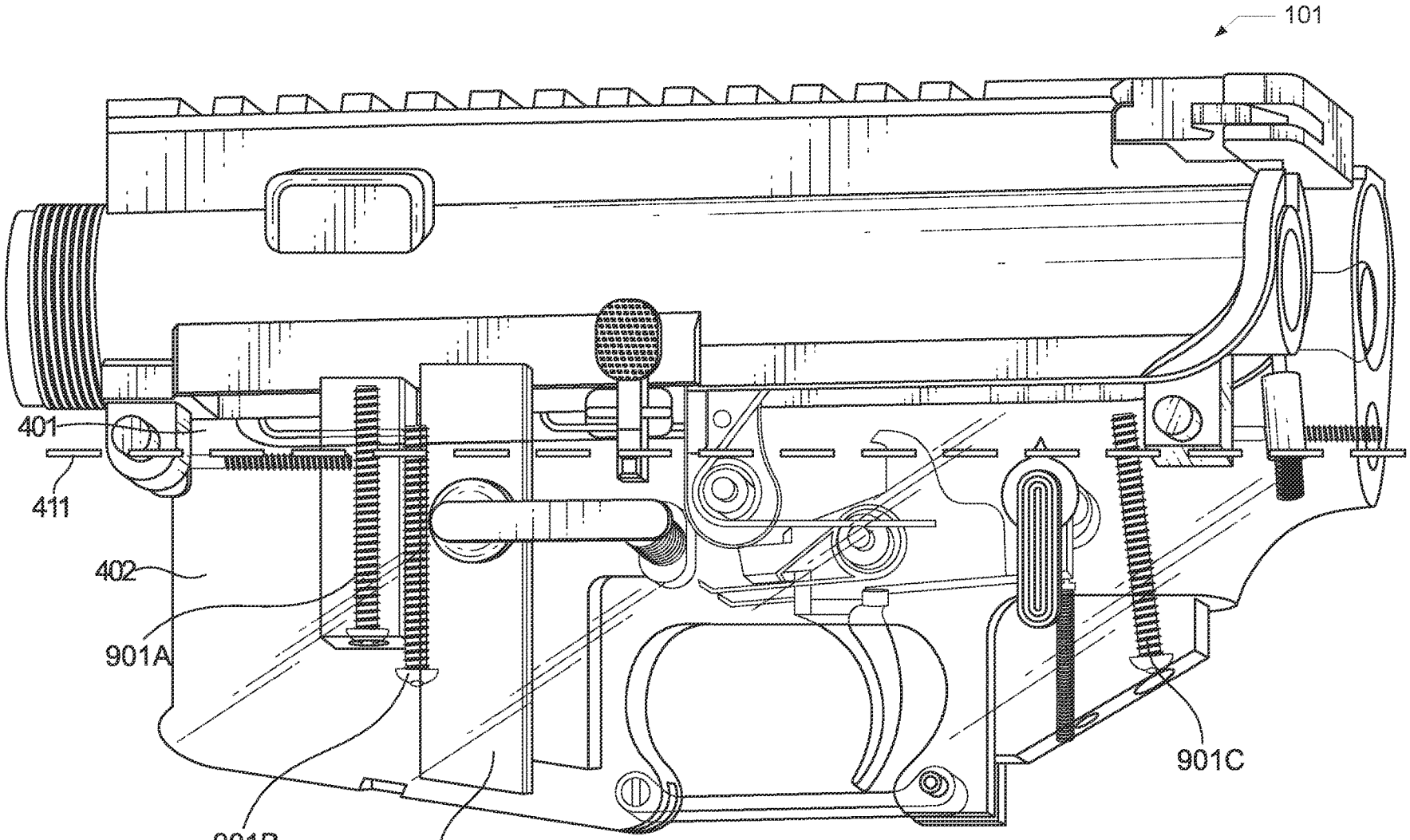
FIG. 9 illustrates a transparent first lower receiver, according to one embodiment of the present disclosure.

Referring now to FIG. 9, illustrated is a transparent first lower receiver 201, according to one embodiment of the present disclosure. The first lower receiver 201 includes screws 901A-C, which hold together the lower receiver metal component 601 to the lower receiver polymer component 602. The screws 901A-C can include threaded rods, bolts, machine screws, or other threaded fasteners. The screws 901A and 901B can extend through the appending bodies 321A-B (not pictured). The screw 901C can extend through the base of the lower receiver polymer component 602 and can extend through the lower receiver metal component 601. The location of this screw 901C is above the grip 203 (not pictured) and at the center of the multi-material firearm 100. With three screws 901A-C, the lower receiver metal component 601 and the lower receiver polymer component 602 can join together and create a substantially suitable connection. In various embodiments, the screws 901A-C are replaceable with any appropriate appending techniques. Some appropriate appending techniques can include, but are not limited to, pins, rivets, and glue.

Figure 10:
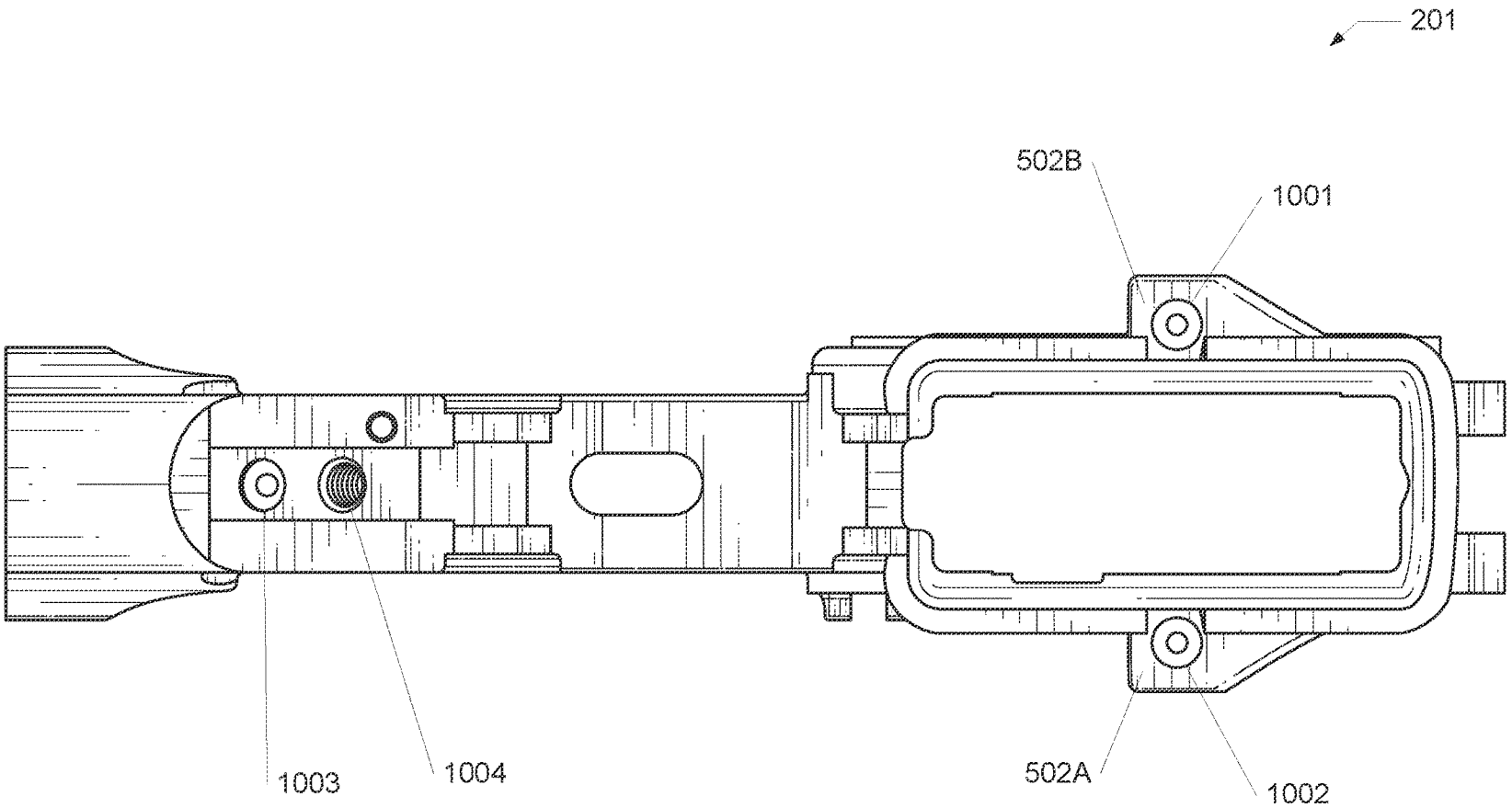
FIG. 10 illustrates a bottom view of the first lower receiver, according to one embodiment of the present disclosure.

Referring now to FIG. 10, illustrated is a bottom view of the first lower receiver 201, according to one embodiment of the present disclosure. In various embodiments, the polymer attachment components 502A-B can include apertures 1002 and 1001, respectively. The apertures 1002 and 1001 can accept the screws 901A and 901B, respectively. The screws 901A and 901B can be long enough to extend through the polymer attachment component 502 and the metal attachment component 501. Any other particular appending technique can be applied to the apertures 1002 and 1001 to fix the lower receiver metal component 601 to the lower receiver polymer component 602.

The first lower receiver can include a third aperture 1003 and a grip aperture 1004. The grip aperture 1004 can receive a screw that attaches the grip 203 to the first lower receiver 201. The third aperture 1003 can receive the screw 901C. The screw 901C can extend through the first lower receiver 201. By extending through the first lower receiver 201, the screw 901C can connect the lower receiver metal component 601 to the lower receiver polymer component 602.

Figure 11:
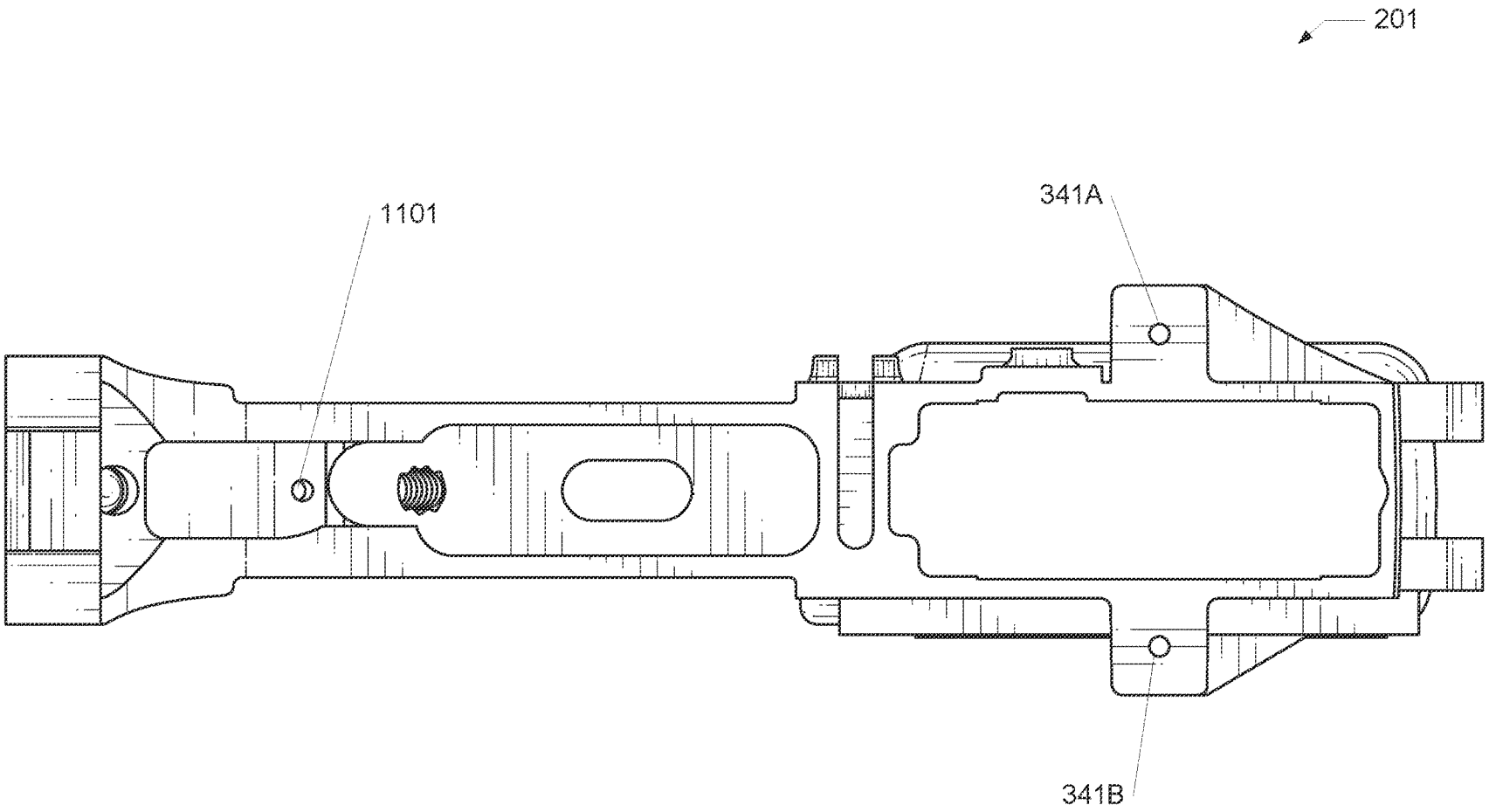
FIG. 11 illustrates a top view of the first lower receiver, according to one embodiment of the present disclosure.

Referring now to FIG. 11, illustrated is a top view of the first lower receiver 201, according to one embodiment of the present disclosure. In various embodiments, the first lower receiver 201 can include a top aperture 1101. Similar to the apertures 341A-B, the top aperture 1101 can define screwing locations for the lower receiver metal component 601. The screws 901A-C can be inserted through the apertures 1001, 1002, and 1003. The screws 901A-C can be inserted through the apertures 341A, 341B, and 1101.

Figure 12:
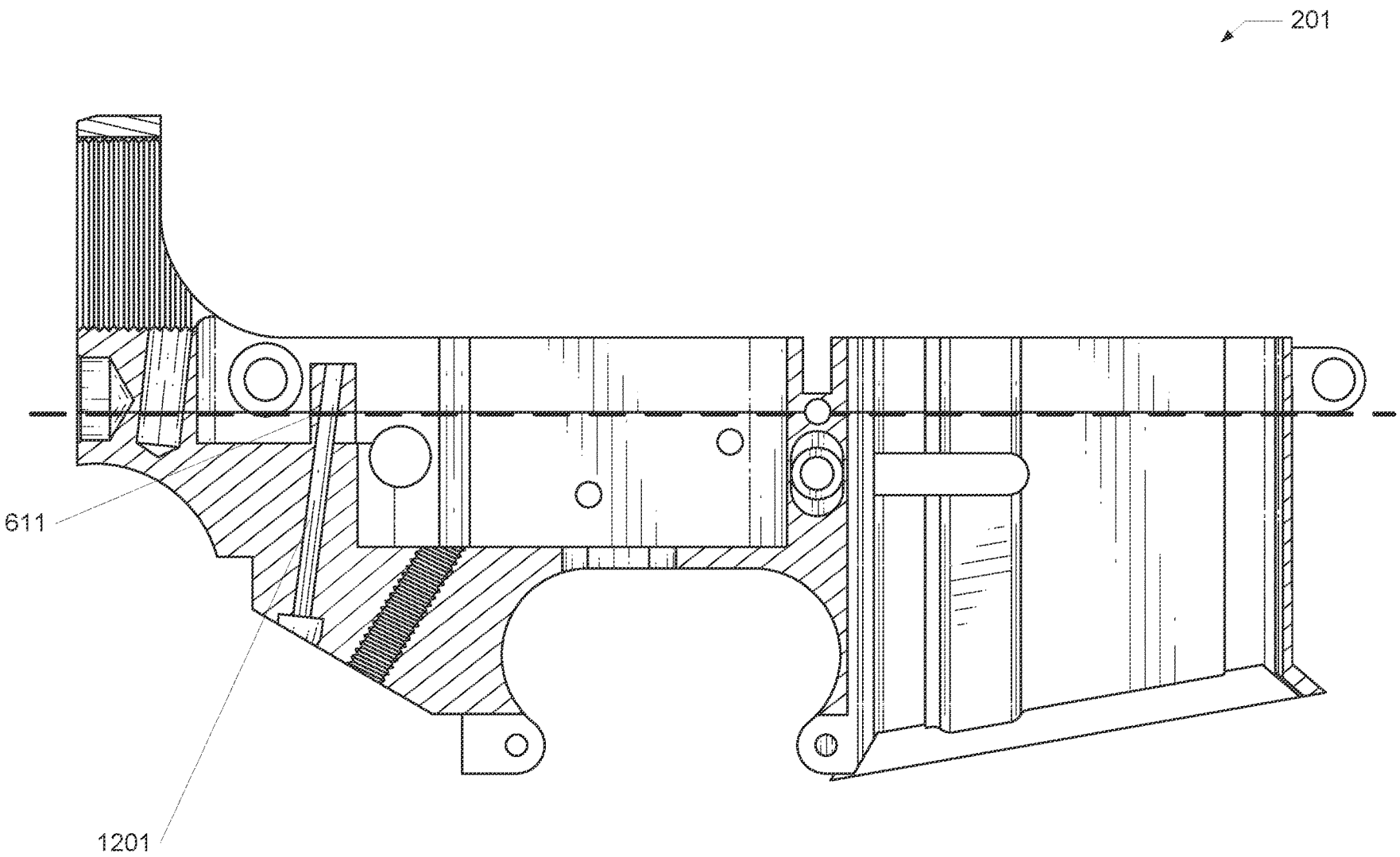
FIG. 12 illustrates a cross-section view of the first lower receiver, according to one embodiment of the present disclosure.

Referring now to FIG. 12, illustrated is a cross-section view of the first lower receiver 201, according to one embodiment of the present disclosure. In various embodiments, the first lower receiver 201 can include an appending channel 1201. Similar to the appending channels that extend through the appending bodies 321A-B, the appending channel 1201 can extend through the lower receiver metal component 601 and the lower receiver polymer component 602. For example, the appending channel 1201 can extend past the merging line 611. In various embodiments, the appending channel 1201 can include a threaded surface that receives a screw or any other threaded appending material.

Figure 13:
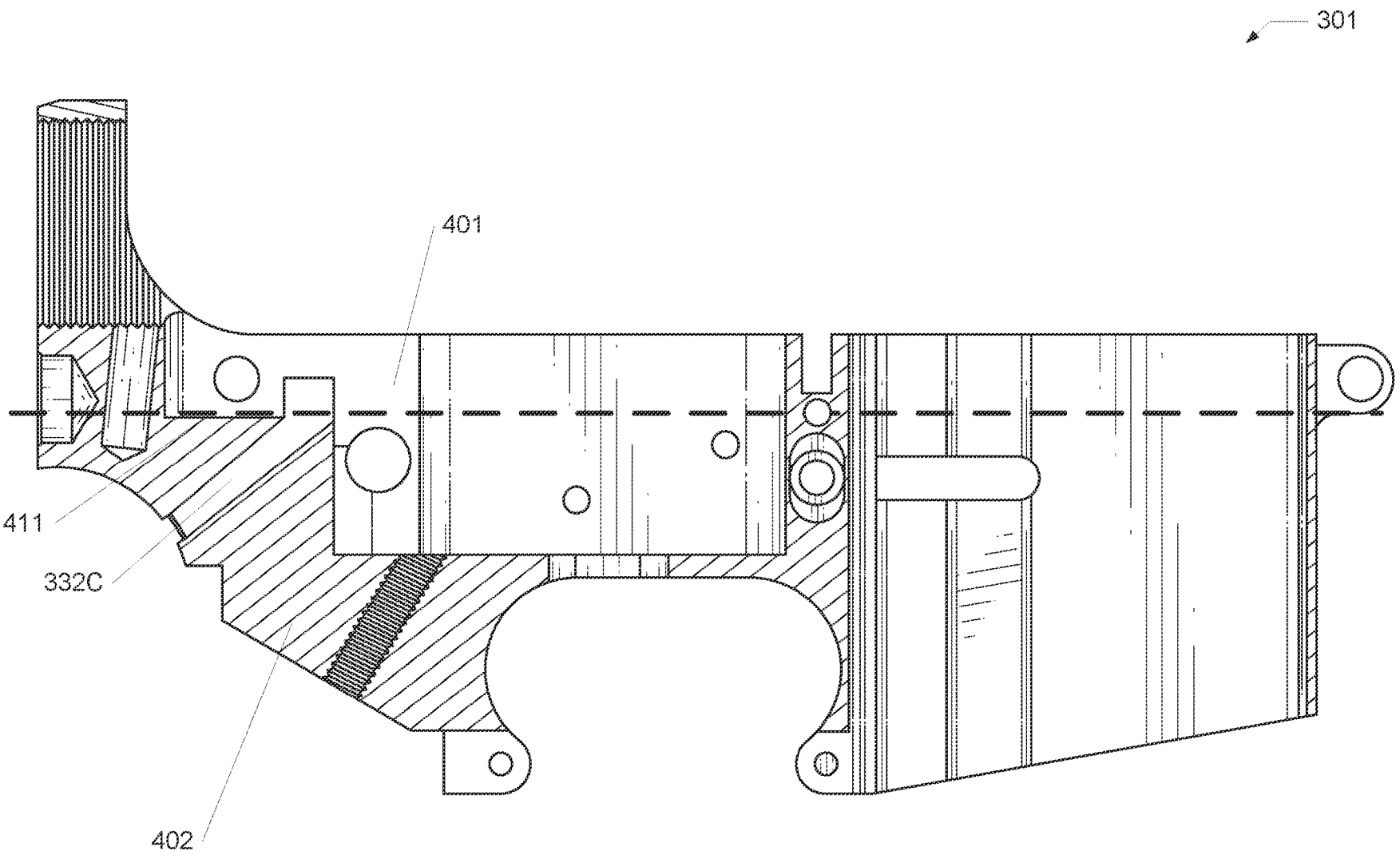
FIG. 13 illustrates a cross-section view of the second lower receiver, according to on embodiment of the present disclosure.

Referring now to FIG. 13, illustrated is a cross-section view of the second lower receiver 301, according to one embodiment of the present disclosure. The second lower receiver 301 can include an appending channel 332C. The appending channel 332C can extend through the lower receiver metal component 401 and the lower receiver polymer component 402. In some embodiments, a pin, a screw, a ridged metal material, and/or any other appropriate appending mechanism can extend through the appending channel 332C. For example, a pin can be pressure fit into the appending channel 332C, fixing the lower receiver metal component 401 to the lower receiver polymer component 402. The appending channel 332C can extend past the merging line 411.

Figure 14:
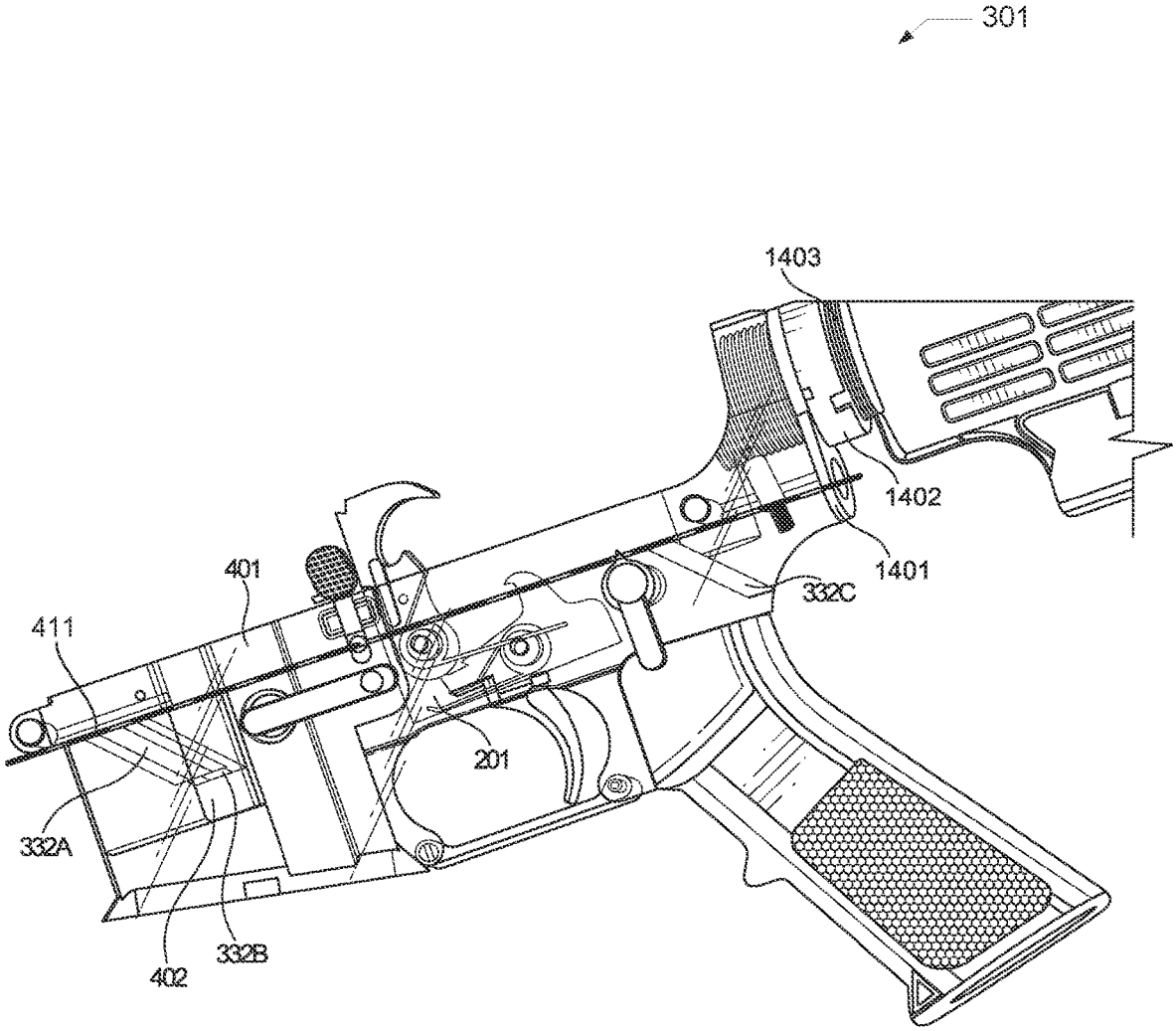
FIG. 14 illustrates a transparent first lower receiver, according to one embodiment of the present disclosure.

Referring now to FIG. 14, illustrated is the second lower receiver 301, according to one embodiment of the present disclosure. The second lower receiver 301 can include three appending channels 332A-C and appending legs 331A-C (not pictured). The appending channel 332A and the appending channel 332B can be substantially similar and protrude on the surface of the second lower receiver 301. The appending leg 331A (not pictured) and the appending leg 331B (not pictured) can be substantially similar and protrude on the surface of the second lower receiver 301. The appending channel 332C can extend from the lower receiver metal component 401 and through the lower receiver polymer component 402. The connection between the lower receiver polymer component 402 and the lower receiver metal component 401 can be secured by the compressing force of the receiver endplate/anti rotation lock 1401 and castle nut 1402.

In various embodiments, an appropriate appending member can extend from the appending legs 331A-C (not pictured) through the appending channels 332A-C. In one or more embodiments, the appending legs 331A-C and the appending channels 332A-C are at an angle relative to the top surface of the lower receiver metal component 401 such that the endplate/anti rotation lock 1401, once secured by the receiver extension/buffer tube 1403 and castle nut 1402, will compress the lower receiver metal component 401 and the lower receiver polymer component 402 together, forming a substantially suitable connection.

Figure 15:
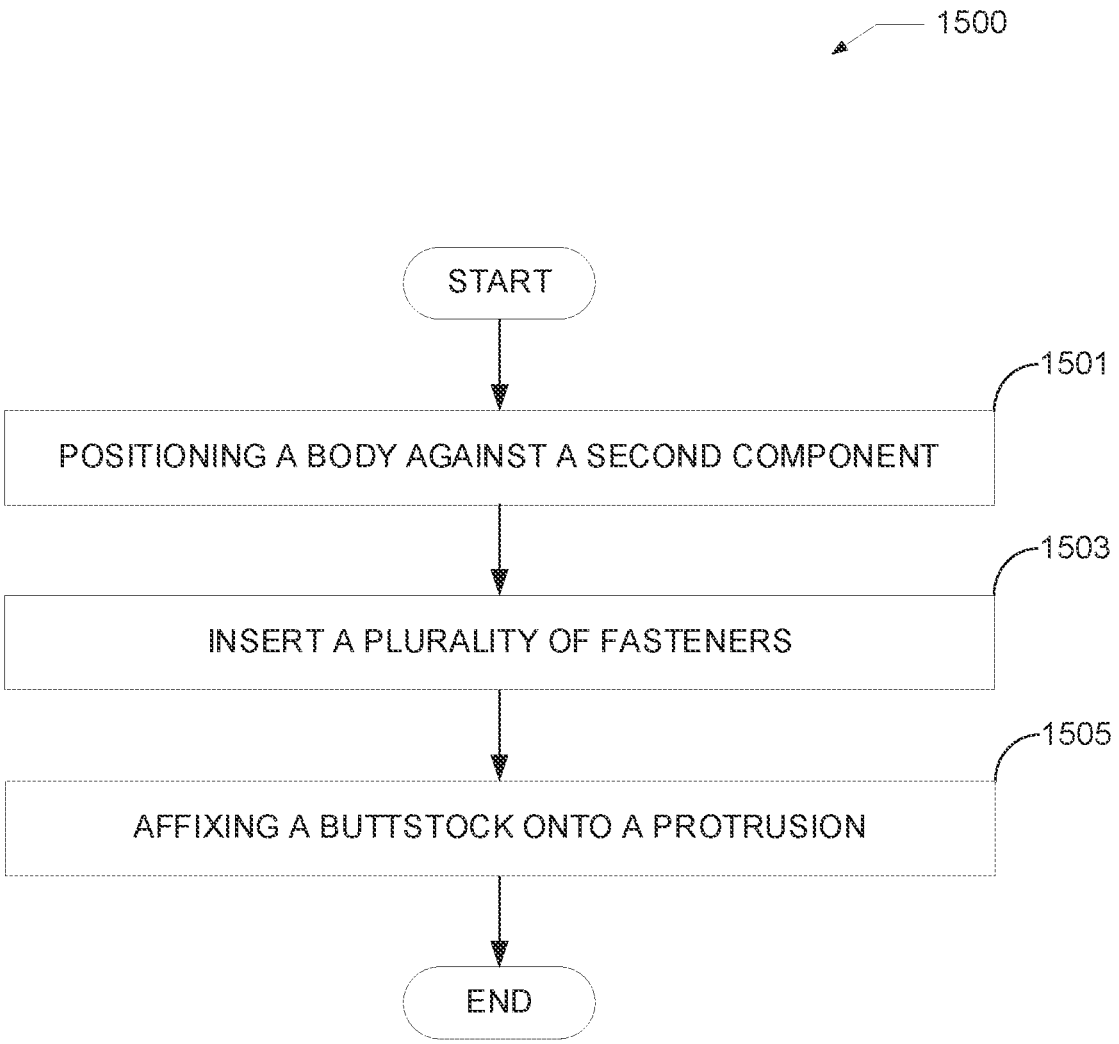
FIG. 15 illustrates a flowchart of a process, according to one embodiment of the present disclosure.

Referring now to FIG. 15, illustrated is a flowchart of a process 1500, according to one embodiment of the present disclosure. The process 1500 can demonstrate a method for constructing the first lower receiver 201, the second lower receiver 301, and/or any other embodiment of a multi-material lower receiver.

At box 1501, the process 1500 can include positioning a second side of a metallic component of the first lower receiver 201 and/or second lower receiver 301 against a second component of the first lower receiver 201 and/or second lower receiver 301. In various embodiments, the lower receiver metal components 401 and 601 can be referred to as metallic components. In various embodiments, the second sides of the lower receiver metal components 401 and 601 can be opposite to the first lower receiver polymer components 402 and 602. In some embodiments, the second sides of the lower receiver metal components 401 and 601 can be located at the merging lines 411 and 611. The second component of the first lower receiver 201 and the second component of the second lower receiver 301 can be referred to as the lower receiver polymer components 402 and 602, respectively. The second side of the lower receiver metal component 601 can mate with a merging surface of the lower receiver polymer component 602. In various embodiments, the merging surface of the lower receiver polymer component 602 is the top surface that contacts the lower receiver metal component 601 during mating. The second side of the lower receiver metal component 401 can make contact with the merging surface of the lower receiver polymer component 402. The merging surface of the lower receiver polymer components 402 and 602 are located at the merging lines 411 and 611. In some embodiments, proper positioning of the lower receiver metal component 601 with respect to the lower receiver polymer component 602 allows screws 901A-C to extend through the appending bodies 321A-B and the channel 1201. Proper positioning of the lower receiver metal component 401 with respect to the lower receiver polymer component 402 can facilitate aligning the appending channels 332A-C. In at least one embodiment, aligning the appending channels 332A-C with the appending legs 331A-C facilitates inserting appending members 1601A-C (see FIG. 16) through the appending channels 332A-C. In some embodiments, the lower receiver metal components 401 and 601 are detachably affixed to the lower receiver polymer components 402 and 602.

At box 1503, the process 1500 can include inserting fasteners to secure the lower receiver metal components 401 and 601 to the lower receiver polymer components 402 and 602, respectively. In some embodiments, the lower receiver metal components 401 and 601 can be fastened to the lower receiver polymer components 402 and 602 by extending a fastening device through the respective components. In some embodiments, the lower receiver metal components 401 can be coupled to the lower receiver polymer components 402 without the use of fasteners. The lower receiver metal components 401 and 601 and the lower receiver polymer components 402 and 602 can be shipped to a user for assembly by the user. In one example, screws (e.g., screws 901A-C) can pass through the apertures 1001, 1002, and 1003. Continuing this example, the screws can extend through the lower receiver polymer component 602 and through the lower receiver metal component 601. The screws can extend partially through the lower receiver metal component 601. In some embodiments, the screws can lock into place, fastening the lower receiver polymer component 602 to the lower receiver metal component 601. The screws can extend through the apertures 341A and 341B located on the first side 521 of the lower receiver metal component 601. In another example, a pin can be pressure fit through the channels 332A-C of the second lower receiver 301 to append the lower receiver metal component 401 to the lower receiver polymer component 402. Other types of fasteners can include, but are not limited to, bolts, removable pins, rivets, pegs, glue, welding material, and tape. Fastening the lower receiver metal components 401 and 601 to the lower receiver polymer components 402 and 602 can also include gluing, sealing, welding, and/or any other appropriate appending technique. For example, glue can be applied at the merging lines 411 and 611 to increase the hold between the lower receiver metal components 401 and 601 and the lower receiver polymer components 402 and 602. In another example, pins can be welded into the appending channels 332A-C to increase the hold between the lower receiver metal component 401 and the lower receiver polymer component 402.

At box 1505, the process 1500 can include affixing the buttstock 103 onto the rotation lock 1401, castle nut 1402, and extension tube 1403 at a first end of the lower receiver metal components 401 and 601. In various embodiments, the first end of the lower receiver metal components 401 and 601 can include the first threads 311. In certain embodiments, the first threads are embedded into a ring-shaped protrusion 371. The ring-shaped protrusion 371 extends perpendicularly to the top surface of the lower receiver 201. The first end of the lower receiver metal components 401 and 601 can include the rotation lock 1401, castle nut 1402, and the extension tube 1403. In particular embodiments, the buttstock 103 is received by the castle nut 1402 and the extension tube 1403. By affixing the buttstock 103 to the lower receiver metal components 401 and 601, the rotation lock 1401 clutches the lower receiver metal components 401 and 601 closer to the lower receiver polymer components 402 and 602. The added compression from affixing the buttstock 103 to the lower receiver metal components 401 and 601 increases the appendage between the lower receiver metal components 401 and 601 and the lower receiver polymer components 402 and 602.

Figure 16:
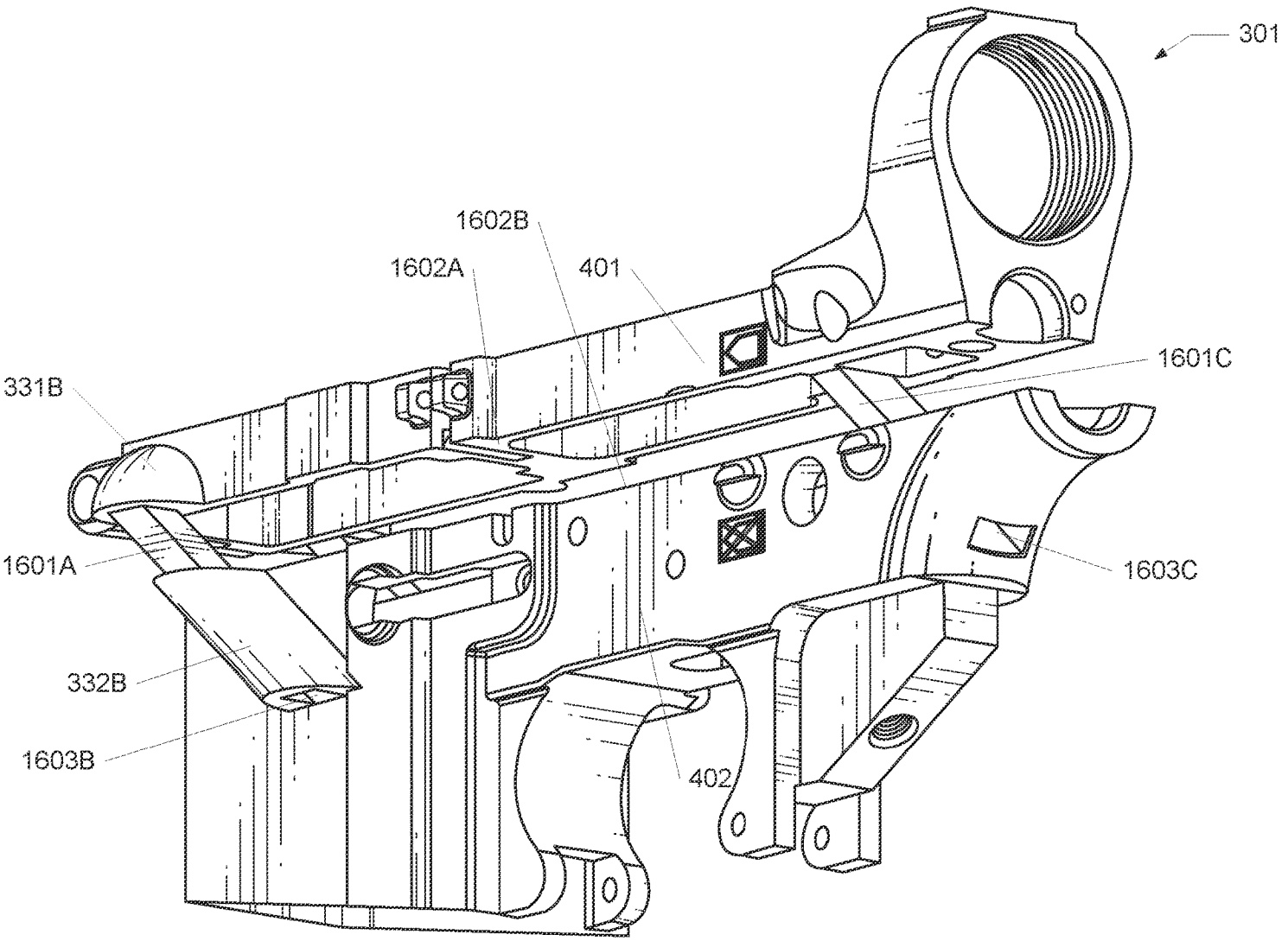
FIG. 16 illustrates a perspective view of a partially decoupled second lower receiver, according to one embodiment of the present disclosure.

Referring now to FIG. 16, illustrated is a perspective view of a partially decoupled second lower receiver 301, according to one embodiment of the present disclosure. In various embodiments, the lower receiver metal component 401 separates from the lower receiver polymer component 402. The appending legs 331A-C can include appending members 1601A-C. The appending members 1601A-C can be ridged and/or smooth materials that extend from the lower receiver metal component 401. For example, the appending legs 331A-C can include the appending members 1601A-C extending from a base 1602A of the lower receiver metal component 401. The appending members 1601A-C can extend from the base 1602A at a particular angle. In one embodiment, the particular angle of the appending members 1601A-C can be 40 degrees measuring relative to the merging line 411 and/or the merging line 611. In some embodiments, the particular angle of the appending members 1601A-C can be at least 10 degrees, 10-60 degrees, 10-20 degrees, 20-30 degrees, 30-40 degrees, 40 degrees, 40-50 degrees, 50-60 degrees, or less than 60 degrees. The appending members 1601A-C can be constructed from the same material used for the lower receiver metal component 401. In some embodiments, the appending members 1601A-C can be made from a hardened metal. In some embodiments, the lower receiver metal component 401 and the appending members 1601A-C can be formed as one continuous component. The lower receiver polymer component 402 can include appending channel apertures 1603A-C. The appending members 1601A-C can extend through the appending channels 332A-C. In certain embodiments, the appending members 1601A-C can extend from a top surface 1602B of the lower receiver polymer component 402 to the appending channel apertures 1603A-C when in a compressed configuration. In particular embodiments, the compressed configuration can include when the base 1602A of the lower receiver metal component 401 makes contact with the top surface 1602B of the lower receiver polymer component 402.

Figure 17:
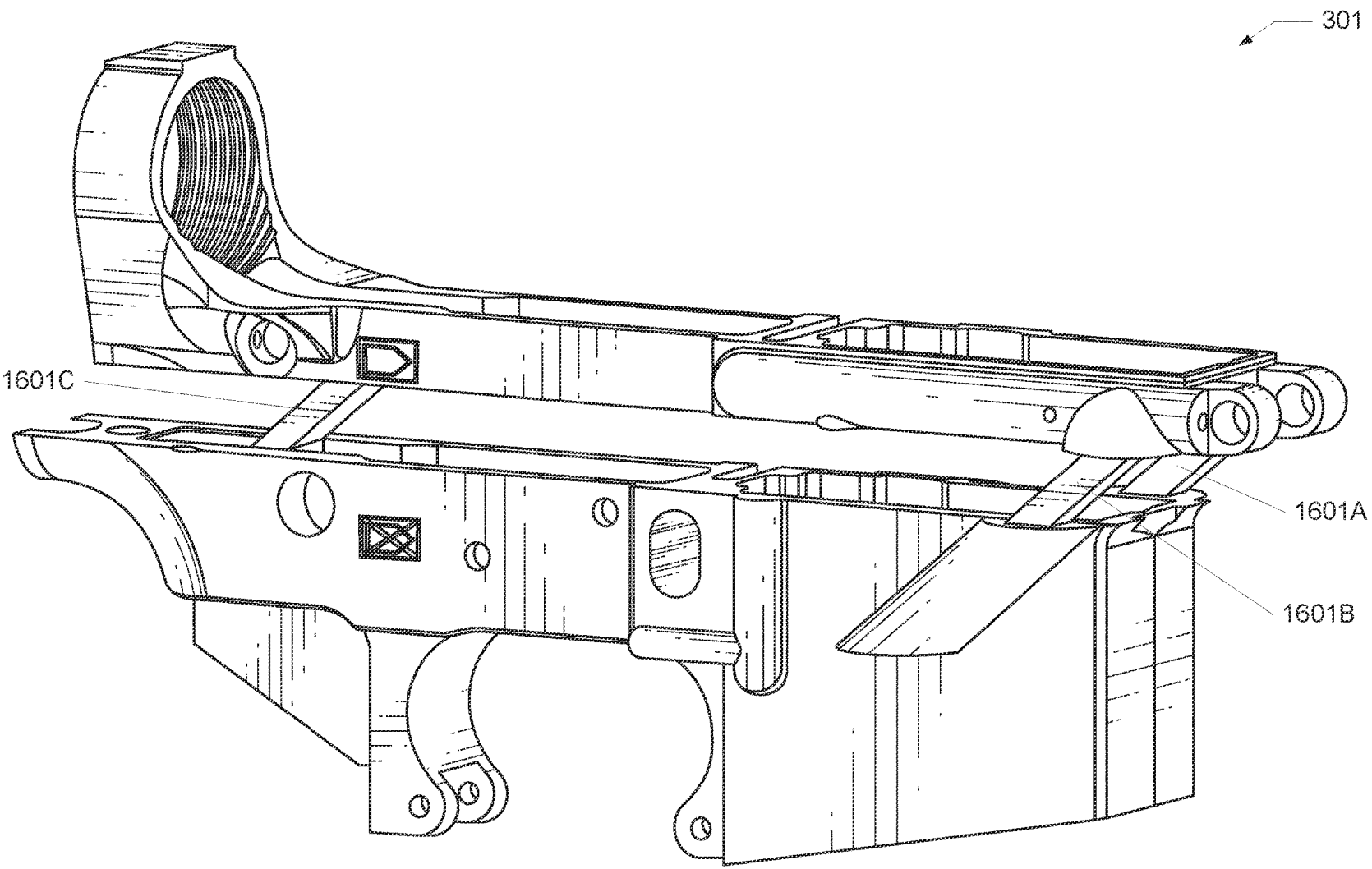
FIG. 17 illustrates a perspective view of a partially decoupled second lower receiver, according to one embodiment of the present disclosure.

Referring now to FIG. 17, illustrated is a perspective view of a partially decoupled second lower receiver 301, according to one embodiment of the present disclosure. In some embodiments, the lower receiver metal component 401 can include three appending members 1601A-C. In at least one embodiment, a lower receiver metal component 401 includes at least one appending member.

Figure 18:
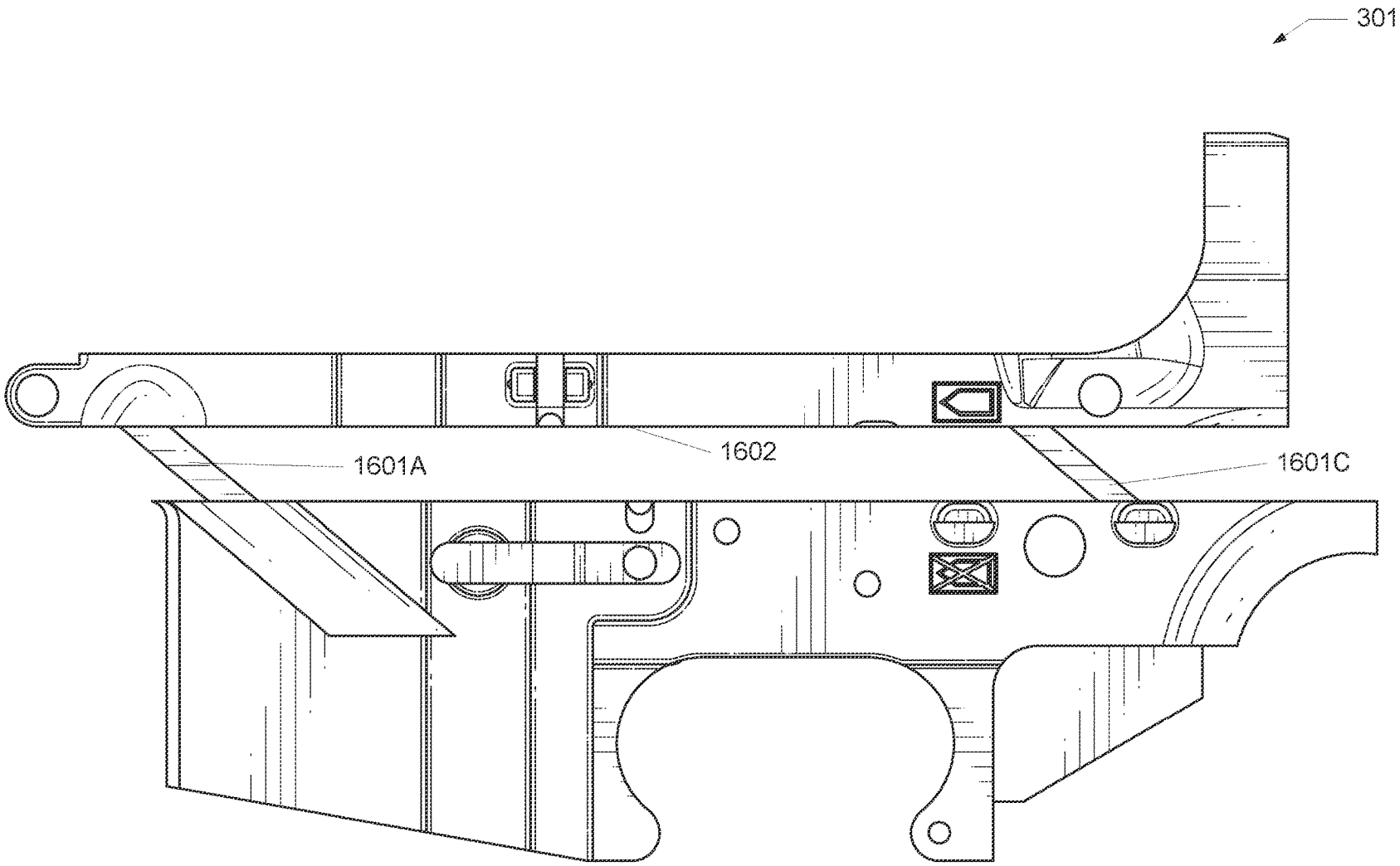
FIG. 18 illustrates a side view of a partially decoupled second lower receiver, according to one embodiment of the present disclosure.

Referring now to FIG. 18, illustrated is a side view of a partially decoupled second lower receiver 301, according to one embodiment of the present disclosure. The appending legs 1601A-C can be angled in a particular direction relative to the base 1602 of the lower receiver metal component 401. In particular embodiments, the angle made between the base 1602 and the appending legs 1601A-C can be at least 10 degrees, 10-90 degrees, 10-40 degrees, 40-70 degrees, 45 degrees, 70-90 degrees, or less than 90 degrees.

Figure 19:
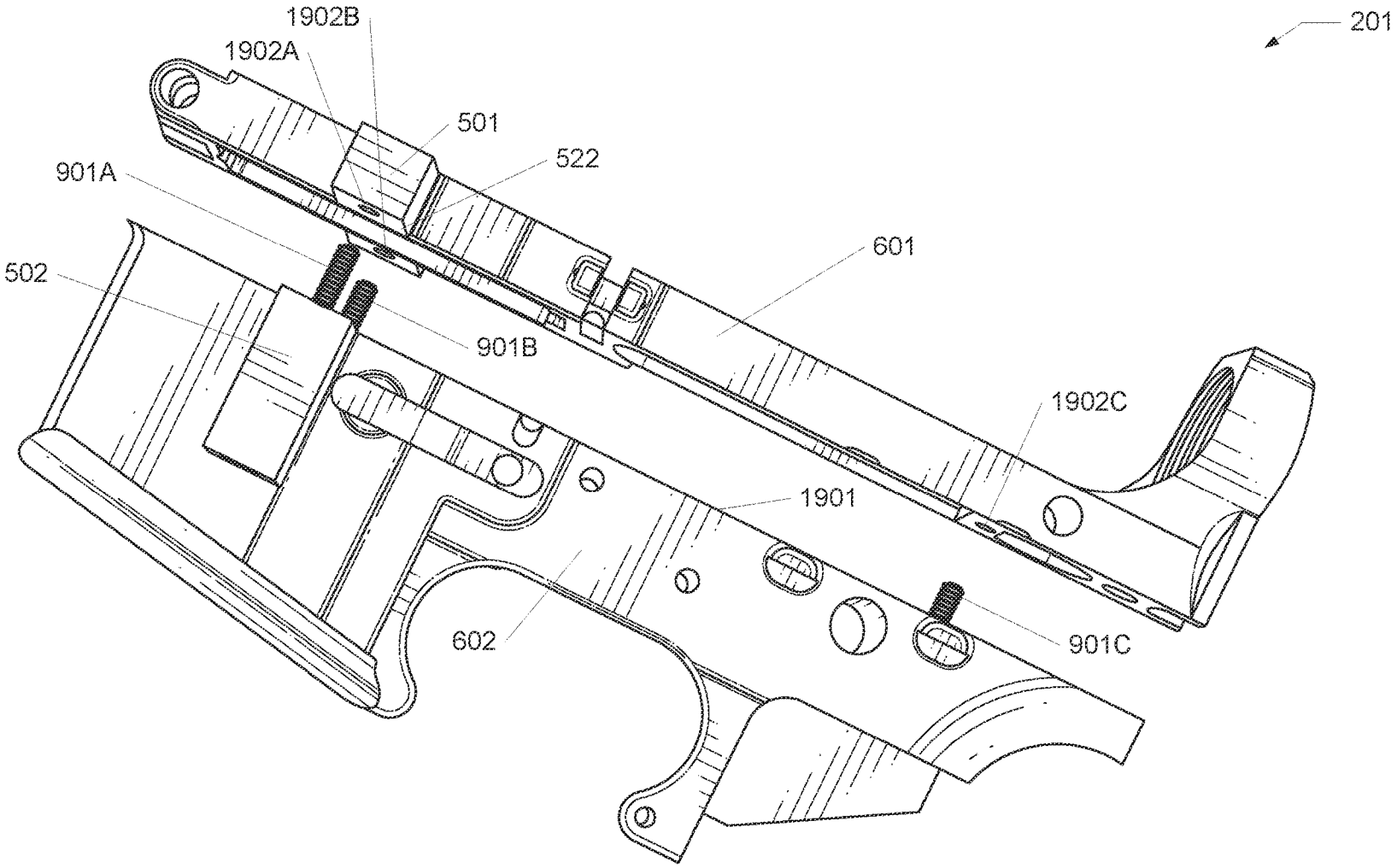
FIG. 19 illustrates a perspective view of a decoupled the first lower receiver, according to one embodiment of the present disclosure.

Referring now to FIG. 19, illustrated is a perspective view of a decoupled first lower receiver 201, according to one embodiment of the present disclosure. In some embodiments, the first lower receiver 201 can separate into the lower receiver metal component 601 and the lower receiver polymer component 602. In some embodiments, the screws 901A-C extend through the polymer attachment component 502 and any other location for accepting screws 901A-C. The screws 901A-C can protrude through a top surface 1901 of the lower receiver polymer component 602. In at least one embodiment, the screws 901A-C are removable to allow a separation between the first lower receiver metal component 601 and a first lower receiver polymer component 602. The screws 901A-C can be threaded through the polymer attachment component 502 and any other location for accepting screws 901A-C. In some embodiments, the polymer attachment components 502 can include apertures that the screws 901A-C can freely pass through except for a head of the screws 901A-C which can provide a pulling force on an insertion end of the polymer attachment components 502 toward the metal attachment component 501 when the screw 901-A-C is threaded into the metal attachment component 501. The second surface 522 of the lower receiver metal component 601 can be aligned with the screws 901A-C and the top surface 1901 of the lower receiver polymer component 602. The screws 901A-C can extend through appending apertures 1902A-C.

The metal attachment component 501 and any other location for accepting screws 901A-C can receive the screws 901A-C. The screws 901A-C can thread into the lower receiver metal component 601 through the appending apertures 1902A-C. In some embodiments, the screws 901A-C are replaced with ridged materials extending from the lower receiver polymer component 602. In at least one embodiment, the ridged materials extending from the lower receiver polymer component 602 can have a larger diameter than the diameter of the appending apertures 1902A-C. On aligning the ridged materials extending from the lower receiver polymer component 602 with the appending apertures 1902A-C, the lower receiver metal component 601 and the lower receiver polymer component 602 can be pressed together. The ridged materials extending from the lower receiver polymer component 602 can pressure fit through the appending apertures 1902A-C and fix the lower receiver polymer component 602 to the lower receiver metal component 601. In some embodiments, the screws A-C can be injection molded into the polymer attachment components 502.

Figure 20:
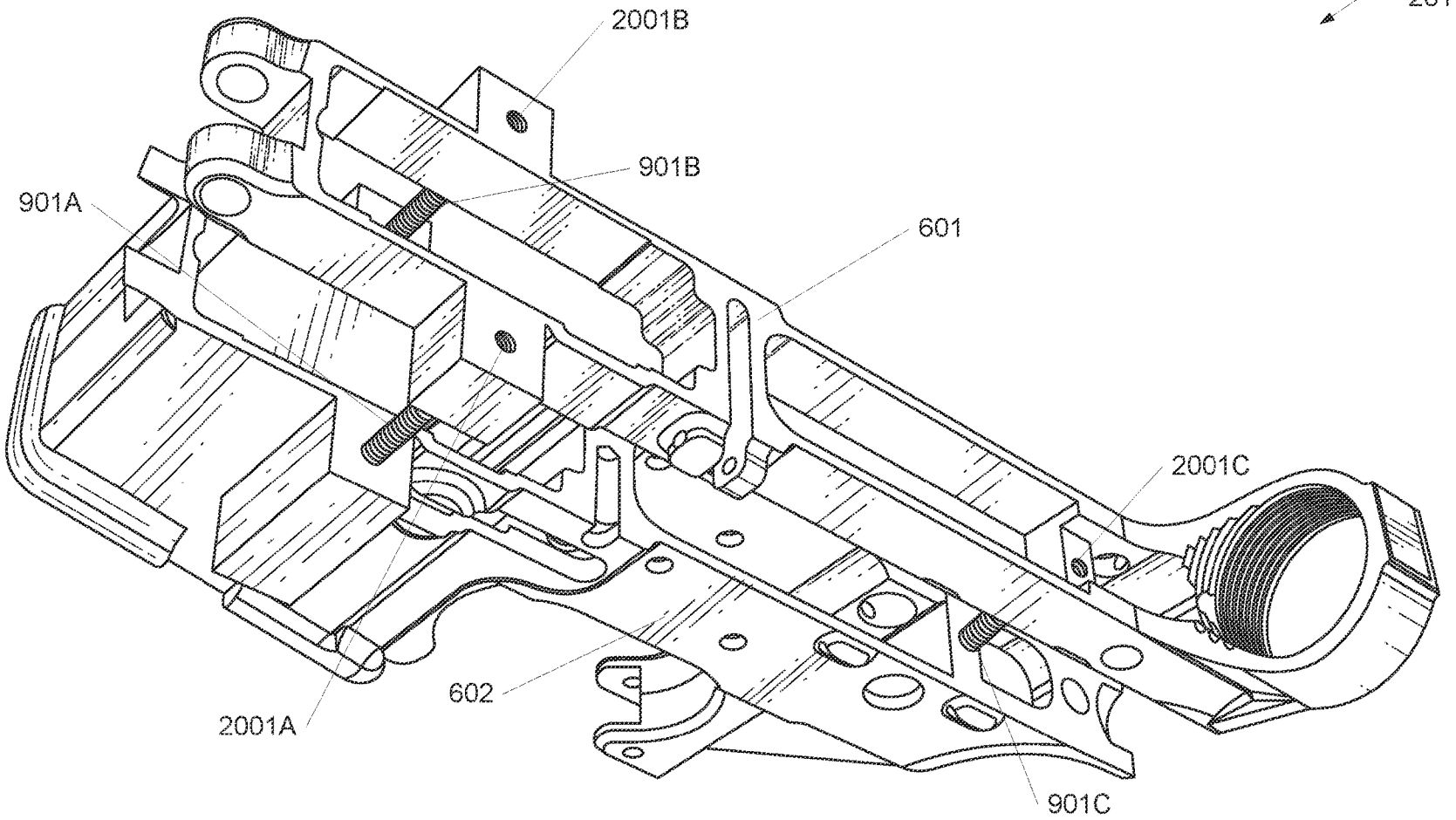
FIG. 20 illustrates a perspective view of a partially decoupled first lower receiver, according to one embodiment of the present disclosure.

Referring now to FIG. 20, illustrated is a perspective view of a decoupled first lower receiver 201, according to one embodiment of the present disclosure. The lower receiver metal component 601 can include threaded appending channels 2001A-C. In at least one embodiment, the threaded appending channels 2001A-C can accept the screws 901A-C. In some embodiments, the screws 901A-C can thread through the threaded appending channels 2001A-C to merge the lower receiver metal component 601 with the lower receiver polymer component 602.

Figure 21:
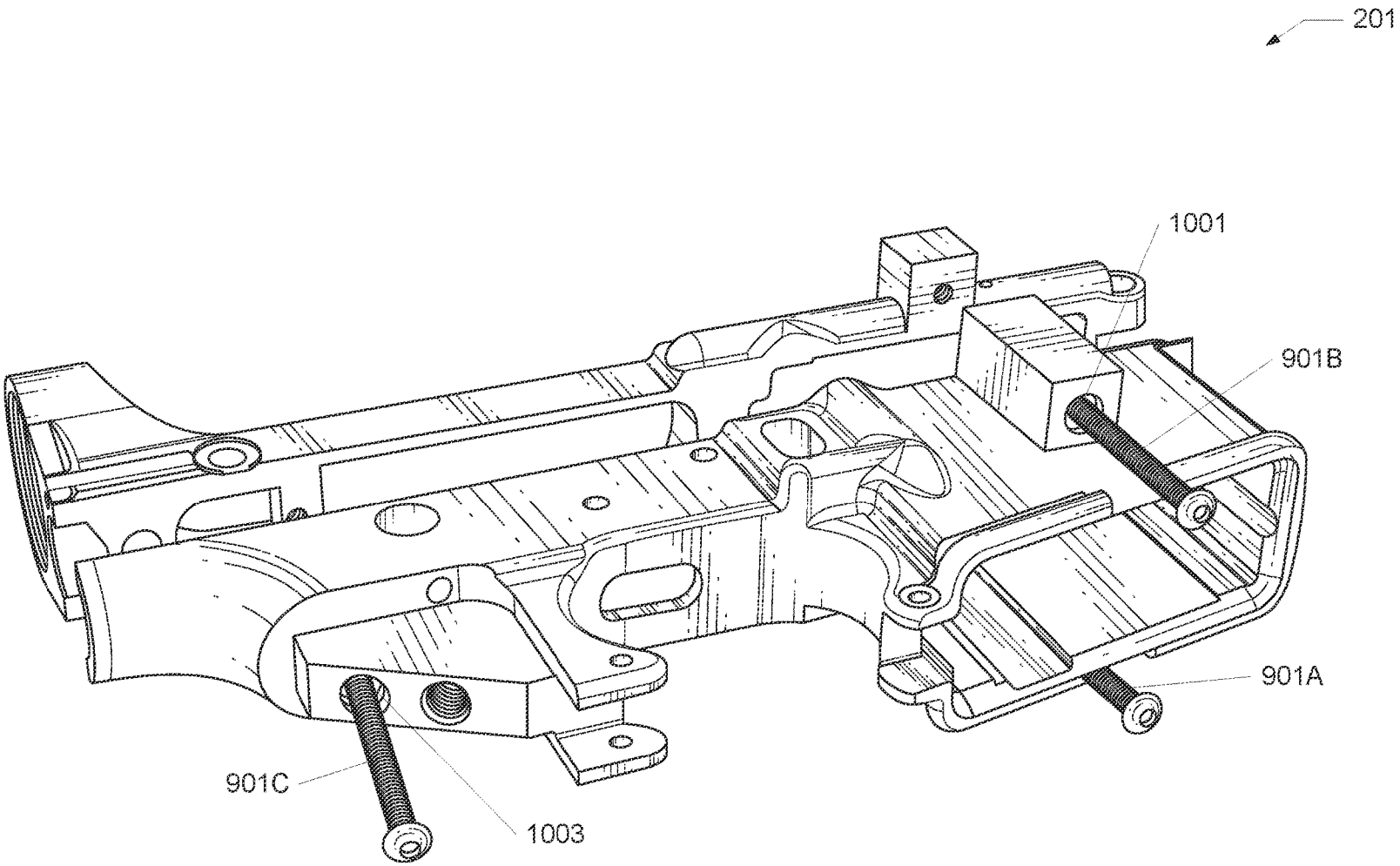
FIG. 21 illustrates a perspective view of a partially decoupled first lower receiver, according to one embodiment of the present disclosure.

Referring now to FIG. 21, illustrated is a perspective view of a decoupled first lower receiver 201, according to one embodiment of the present disclosure. The screws 901A-C can extend through the apertures 1001, 1002 (not pictured), and 1003. The screws can extend through the lower receiver polymer component 602 and the lower receiver metal component 601.

Figure 22:
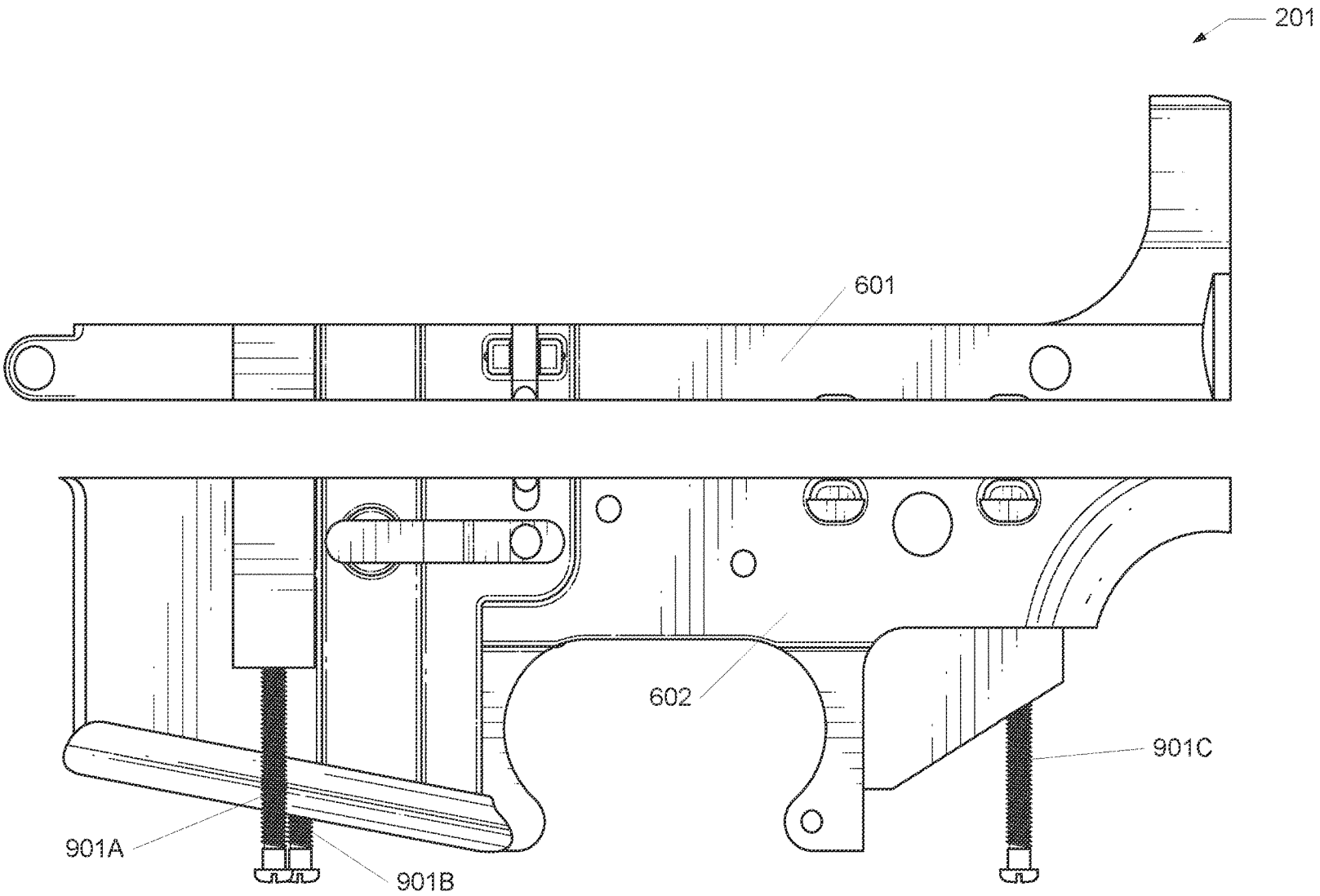
FIG. 22 illustrates a side view of the first lower receiver in a detached configuration, according to one embodiment of the present disclosure.

Referring now to FIG. 22, illustrated is a side view of the first lower receiver 201 in a detached/decoupled configuration, according to one embodiment of the present disclosure. In some embodiments, the screws 901A-C can be removed to detach the lower receiver polymer component 602 from the lower receiver metal component 601. Once removed, the lower receiver metal component 601 can be moved freely from the lower receiver polymer component 602.

Figure 23:
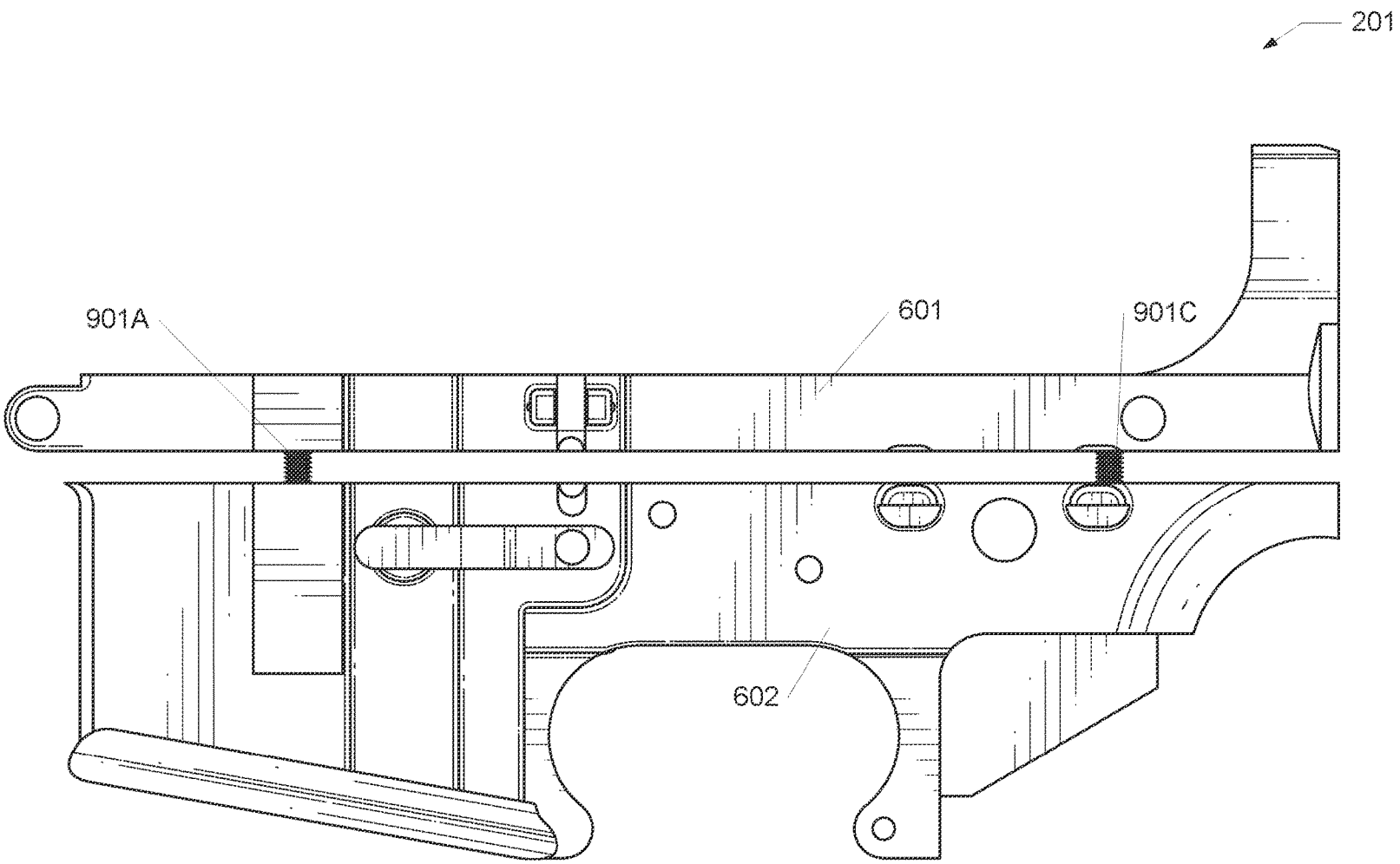
FIG. 23 illustrates a side view of the first lower receiver in a semi-attached configuration, according to one embodiment of the present disclosure.

Referring now to FIG. 23, illustrated is a side view of a partially decoupled first lower receiver 201 in a semi-attached configuration, according to one embodiment of the present disclosure. The screws 901A-C can be threaded into the lower receiver polymer component 602 and the lower receiver metal component 601 to reattach the lower receiver polymer component 602 to the lower receiver metal component 601.

The foregoing description of the exemplary embodiments has been presented only for the purposes of illustration and description and is not intended to be exhaustive or to limit the inventions to the precise forms disclosed. Many modifications and variations are possible in light of the above teaching.

The embodiments were chosen and described in order to explain the principles of the inventions and their practical application so as to enable others skilled in the art to utilize the inventions and various embodiments and with various modifications as are suited to the particular use contemplated. Alternative embodiments will become apparent to those skilled in the art to which the present inventions pertain without departing from their spirit and scope.

What is claimed is:

1. A metallic component of a lower receiver for a firearm, comprising:

a body comprising a plurality of apertures between a first side and a second side opposite the first side, wherein the body is configured to mate with a second component of the lower receiver along the second side and to be detachably affixed to the second component of the lower receiver via the plurality of apertures; and a ring-shaped protrusion at a first end of the body, the ring-shaped protrusion extending outward from the first side away from the second side and perpendicular to the first side and the second side.

2. The metallic component of claim 1, wherein the metallic component comprises a first material with a first compressive strength exceeding a second compressive strength of a second material of the second component of the lower receiver.

3. The metallic component of claim 1, wherein the metallic component comprises a first material with a first shear strength exceeding a second shear strength of a second material of the second component of the lower receiver.

4. The metallic component of claim 1, wherein the ring-shaped protrusion is configured to mate between a buttstock and an upper receiver of the firearm.

5. The metallic component of claim 1, wherein individual ones of the plurality of apertures comprise respective threads and the body is configured to mate with the second component of the lower receiver by individual inserting a plurality of screws through a plurality of second apertures in the second component of the lower receiver and secured into the respective threads.

6. The metallic component of claim 1, wherein the body is configured to mate with the second component of the lower receiver by individual inserting a plurality of screws through a respective one the plurality of apertures and into the second component of the lower receiver.

7. The metallic component of claim 1, wherein the body is configured to mate with the second component of the lower receiver by individual inserting a plurality of pins through a respective one the plurality of apertures and into the second component of the lower receiver.

8. A method, comprising:

positioning a second side of a body of a metallic component of a lower receiver against a second component of the lower receiver;

inserting a plurality of fasteners to secure the metallic component with the second component, wherein the plurality of fasteners at least partially pass into a plurality of apertures between a first side of the metallic component and the second side of the metallic component, wherein the first side is opposite the second side; and affixing a buttstock onto a ring-shaped protrusion at a first end of the body of the metallic component.

9. The method of claim 8, wherein inserting the plurality of fasteners comprises individually inserting a plurality pins through the second component and into a respective one of the plurality of apertures in the metallic component.

10. The method of claim 8, wherein inserting the plurality of fasteners comprises:

inserting a plurality of screws through the second component; and individually screwing each of the plurality of screws into a respective one of the plurality of apertures in the metallic component.

11. The method of claim 8, further comprising printing, via a three-dimensional printer, at least a portion of the second component of the lower receiver.

12. The method of claim 8, wherein the metallic component comprises a lesser volume than the second component, and the metallic component comprises a greater weight than the second component.

13. The method of claim 8, further comprising affixing an upper receiver against the ring-shaped protrusion opposite the buttstock.

14. The method of claim 8, wherein the buttstock comprises a buffer tube and a spring.

15. The method of claim 8, further comprising shipping the metallic component to a user for assembly by the user.

16. The method of claim 8, further comprising injecting a plastic material into a mold to form the second component.

17. A system, comprising:

a metallic component of a lower receiver of a firearm comprising:

a body comprising a plurality of apertures between a first side and a second side opposite the first side; and a ring-shaped protrusion at a first end of the body, the ring-shaped protrusion extending outward from the first side away from the second side and perpendicular to the first side and the second side; and a plurality of fasteners configured to individually be at least partially inserted into a respective one of the plurality of apertures, wherein the body of the metallic component is configured to be affixed with a second component of the lower receiver via the plurality of fasteners.

18. The system of claim 17, wherein the metallic component is configured to dissipate a kickback force received by the lower receiver in response to a projectile being launched from the firearm.

19. The system of claim 17, wherein the metallic component is configured to couple with an upper receiver along the first side of the body.

20. The system of claim 17, further comprising an end plate positioned against the ring shaped protrusion and configured to:

be secured to the ring shaped protrusion by a castle nut and a buffer tube; and secure the plurality of fasteners in the plurality of apertures to affix the body of the metallic component to the second component of the lower receiver when the end plate is secured to the ring shaped protrusion.

* * * * *